US008354972B2

(12) United States Patent
Borja et al.

(10) Patent No.: US 8,354,972 B2
(45) Date of Patent: Jan. 15, 2013

(54) DUAL-POLARIZED RADIATING ELEMENT, DUAL-BAND DUAL-POLARIZED ANTENNA ASSEMBLY AND DUAL-POLARIZED ANTENNA ARRAY

(75) Inventors: Carmen Borja, Barcelona (ES); Anthony Teillet, Trabuco Canyon, CA (US)

(73) Assignee: Fractus, S.A., Barcelona (ES)

( * ) Notice: Subject to any disclaimer, the term of this patent is extended or adjusted under 35 U.S.C. 154(b) by 630 days.

(21) Appl. No.: 12/602,927

(22) PCT Filed: Jun. 6, 2008

(86) PCT No.: PCT/EP2008/004539

§ 371 (c)(1),
(2), (4) Date: Dec. 3, 2009

(87) PCT Pub. No.: WO2008/148569

PCT Pub. Date: Dec. 11, 2008

(65) Prior Publication Data

US 2010/0171675 A1 Jul. 8, 2010

Related U.S. Application Data

(60) Provisional application No. 60/943,612, filed on Jun. 13, 2007.

(30) Foreign Application Priority Data

Jun. 6, 2007 (EP) ..... 07011177

(51) Int. Cl.
*H01Q 21/26* (2006.01)

(52) U.S. Cl. ..... 343/797; 343/700 MS; 343/815

(58) Field of Classification Search ..... 343/795–797, 343/799–800, 810, 812, 815, 817–818, 833, 343/834, 700 MS
See application file for complete search history.

(56) References Cited

U.S. PATENT DOCUMENTS 4,710,775 A * 12/1987 Coe ..... 343/727
4,916,457 A * 4/1990 Foy et al. ..... 343/770
5,075,691 A 12/1991 Garay et al.
5,241,321 A * 8/1993 Tsao ..... 343/700 MS
5,510,803 A 4/1996 Ishizaka (Continued)

FOREIGN PATENT DOCUMENTS

EP 0735611 A2 10/1996

(Continued)

OTHER PUBLICATIONS

Granholm , J. Dual-Frequency and Dual-Polarization Antennas. Department of Electromagnetic Systems, Technical University of Denmark Aug. 1, 2000.

(Continued)

*Primary Examiner* — Jason M Crawford
(74) *Attorney, Agent, or Firm* — Winstead PC

(57) ABSTRACT

The invention refers to a dual-polarized radiating element (100) with: a first patch (101) provided for radiating in a first polarization and a second patch (102) provided for radiating in a second polarization which is substantially-orthogonal to the first polarization, wherein the first patch (101) and the second patch (102) overlap. Further the invention relates to a dual-band dual-polarized antenna assembly (500) comprising at least one patch antenna elements and/or one set of patch antenna elements (501,502) and to corresponding antenna arrays.

32 Claims, 21 Drawing Sheets

U.S. PATENT DOCUMENTS

Figure 1A:
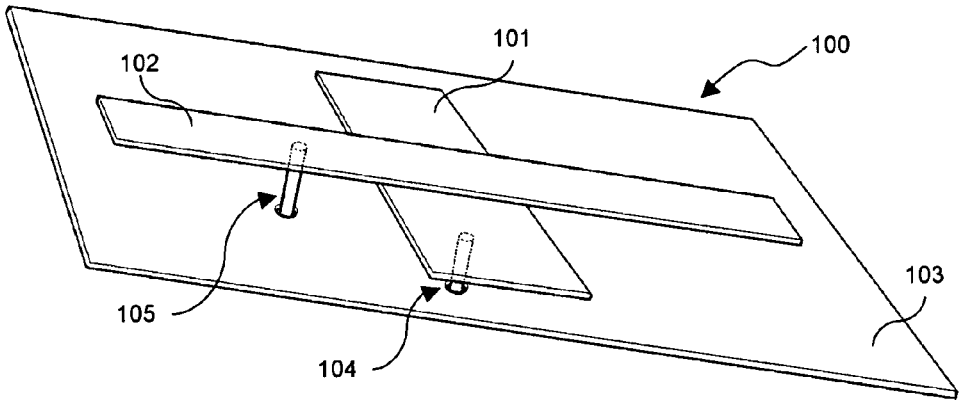

| | | | | |
|---|---|---|---|---|
| 5,923,296 | A | 7/1999 | Sanzgiri | |
| 5,945,951 | A | 8/1999 | Monte | |
| 6,018,319 | A * | 1/2000 | Lindmark | 343/700 MS |
| 6,025,812 | A * | 2/2000 | Gabriel et al. | 343/797 |
| 6,054,953 | A * | 4/2000 | Lindmark | 343/700 MS |
| 6,091,365 | A * | 7/2000 | Derneryd et al. | 343/700 MS |
| 6,104,347 | A | 8/2000 | Snygg | |
| 6,147,648 | A * | 11/2000 | Granholm et al. | 343/700 MS |
| 6,201,501 | B1 | 3/2001 | Arkko et al. | |
| 6,218,989 | B1 | 4/2001 | Schneider | |
| 6,236,367 | B1 | 5/2001 | Du Toit | |
| 6,239,762 | B1 | 5/2001 | Lier | |
| 6,462,710 | B1 | 10/2002 | Carson | |
| 6,937,191 | B2 | 8/2005 | Puente | |
| 7,015,868 | B2 | 3/2006 | Puente | |
| 2002/0014995 | A1 | 2/2002 | Roberts | |
| 2003/0058171 | A1 | 3/2003 | Umehara | |
| 2004/0056818 | A1 | 3/2004 | Sledkov | |
| 2004/0119645 | A1 | 6/2004 | Lee | |

FOREIGN PATENT DOCUMENTS

| | | | |
|---|---|---|---|
| JP | 5-308223 | | 11/1993 |
| WO | 99/31757 | A1 | 6/1999 |
| WO | 01/54225 | A1 | 7/2001 |
| WO | 02/50953 | A1 | 6/2002 |
| WO | 02/084790 | A1 | 10/2002 |
| WO | 2006/024516 | A1 | 3/2006 |
| WO | 2007/042938 | A2 | 4/2007 |

OTHER PUBLICATIONS

Jaggard , D. L. Rebuttal expert report of Dr. Dwight L. Jaggard (redacted version) Fractus Feb. 16, 2011.
Long , S. A. Rebuttal expert report of Dr. Stuart A. Long (redacted version) Fractus Feb. 16, 2011.
Jaggard , D. L. Expert report of Dwight L. Jaggard (redacted)—expert witness retained by Fractus Fractus Jan. 18, 2011.
Munson , R. Conformal microstrip array for a parabolic dish. Symposium on the USAF Antenna Research and Development Program Oct. 1, 1973.
Paschen , D. A. ; Olson , S. A crossed-slot antenna with an infinite balun feed. Antenna Applications Symposium, 1995. Sep. 20, 1995.
Munson , R. Microstrip Antennas—Chapter 7 Antenna Engineering Handbook—Third Edition—McGraw-Hill Jan. 1, 1993.
Rambabu, K. et al. Compact wideband dual-polarized microstrip patch antenna. Antennas and Propagation Society International Symposium, 2004. vol. 2. Jun. 2004.
Pozar, D. et al. A dual-band circularly polarized aperture-coupled stacked microstrip atenna for global positioning satellite. IEEE Transactions on Antennas and Propagation, vol. 45. Nov. 1997.
Lau, K. L., A wide band circularly polarized L-probe coupled patch antenna for dual-band operation. IEEE Transactions on Antennas and Propagation, vol. 53. Aug. 2005.
Brachat, P., Dual-band and dual-polarized gridded patch antenna element. Microwave and Optical Technology Letters, vol. 27. Nov. 2000.
Tavakoli, A. A wide band dual-polarized microstrip patch antenna. Antennas and Propagation Society International Symposium, IEEE Digest. Jul. 1997.
Tavakoli, A. Analysis of cross-shaped dual-polarized microstrip patch antennas. Antennas and Propagation Society International Symposium, IEEE Digest. Jun. 1995.
Lindmark, B. Dual polarised multibeam antenna. Electronic Letters, vol. 35. Dec. 1999.
Binoy, G. S. Compact dual-frequency dual-polarized slotted microstrip patch antenna. Microwave and Optical Technology Letters. vol. 29, Apr. 2001.
Condello, T. Dual band dual polarisation slotted microstrip patch antenna element. Antennas and Propagation Society International Symposium, 2001.
Hettak, K. et al. A novel variant of dual polarized CPW fed patch antenna for broadband wireless communications. Antennas and Propagation Society International Symposium, 2000.
Lyou, M. Compact size dual-polarized WII base-station antenna using aperture coupled microstrip patches. Antennas and Propagation Society International Symposium, 2000.
Kim, Y. et al. A study of wideband dual-frequency dual-polarization microstrip array antenna. Antennas and Propagation Society International Symposium, 2000.
Rostan, F. Dual polarized multilayer aperture-coupled patch antennas for spaceborne application in C- and X-band. Antennas and Propagation Society International Symposium, vol. 1. Jun. 1994.
Wong. K. L. Compact broadband microstrip antennas. John Wiley & Sons, Inc., c2002.
Ferrero , F. et al. Dual-band circularly polarized microstrip antenna for satellite applications. IEEE Antennas and Wireless Propagations Letters. vol. 4. 2005.
Gao, S. A broad-band dual-polarized microstrip patch antenna with aperture coupling. IEEE Transactions on Antennas and Propagation, vol. 51. Apr. 2003.
Ramirez, R. et al. Small size single and multiband antenna arrays with diversity capabilities for portable devices. Radio and Wireless Conference, 2001. RAWCON 2001.
Borja, C. Fractal microstrip patch antennas with fractal perimeter and self-affine properties. (Ph. D. Disertation). Universitat Politécnica de Catalunya, May 2001.
Jenwei, Y. Dual polarized patch antenna for RFID reader. Antennas and Propagation Society International Symposium, 2007 IEEE.
Honarbakhsh, B. J. A single-feed cross-shaped multi-band dual-polarized zeroth-order resonator microstrip antenna. Antennas and Propagation Society International Symposium, Jun. 2007.
Marrero, V. ; Rodríguez, R., Dual polarized microstrip antenna array for X-band radar applications. Antennas and Propagation Society International Symposium, Jun. 2007.
Marrero, V. ; Rodriguez, R. Dual polarized aperture-coupled microstrip patch antenna for X-band series-fed array. Antennas and Propagation Society International Symposium, Jun. 2007.
Ghorbani, K. ; Waterhouse, R.B. Dual polarized wide-band aperture stacked patch antennas. IEEE Transactions on Antennas and Propagation, vol. 52, Aug. 2004.
Liang, X.L. et al. Design of dual-polarized microstrip patch antennas with excellent polarization purity. 3th International Conference on Computational Electromagnetics and its Applications Proceedings. 2004.
Voipio, V. Dual band dual polarized basestation antenna FDTD design study. Antennas and Propagation Society International Symposium, Jun. 2007.
Bokhari, S.A. A small microstrip patch antenna with a convenient tuning option. Antennas and Propagation, IEEE Transactions on. Nov. 1996.
Maci, S. ; Gentili, B. Dual-frequency patch antennas. IEEE Antennas and Propagation Magazine, vol. 39. Dec. 1997.
Chiou, T.Z ; Wong K.L. Broad-band dual-polarized single microstrip patch antenna with high isolation and low cross polarization. IEEE Transactions on Antennas and Propagation. Mar. 2002.
Shackelford, A.K. et al. Small-size probe-fed notched patch antenna with a shorting post. Microwave and Optical Technology Letters, Dec. 2005.
Yang, A. et al. A dual band circularly polarized ring antenna based on composite right and left handed metamaterials. Progress in Electromagnetics Research, PIER 78, 2008.
Chan, T. ; Hwang, Y. A dual-band microstrip array antenna. Antennas and Propagation Society International Symposium, 1995.
Barba, M. A high-isolation, wideband and dual-linear polarization patch antenna. IEEE Transactions on Antennas and Propagation, vol. 56. May 2008.
Wong, K.L. Broad-band dual-polarized patch antennas fed by capacitively coupled feed and slot-coupled feed. IEEE Transactions on Antennas and Propagation, vol. 50. Mar. 2002.
Dubost, G. Wideband flat dipole and short-circuit microstrip patch elements and arrays—Chapter 7. In James, R.J ; Hall, P.S. Handbook of microstrip antennas. Peter Peregrinus, Ltd. c.1989.
Suarez, C. et al. Diseño del elemento básico en una agrupación circular para estaciones base GSM-UMTS. XXI Simposium Nacional de la Union Cientifica Internacional de Radio. 2006.
Chiou, T.W. A compact dual-band dual-polarized patch antenna for 900/1800-MHz cellular systems. IEEE Transactions on Antennas and Propagation, vol. 51. Aug. 2003.
Shafai, L.L. et al. Dual-band dual-polarized perforated microstrip antennas for SAR applications. IEEE Transactions on Antennas and Propagation, vol. 48. Jan. 2000.

* cited by examiner (a)

(b)

DUAL-POLARIZED RADIATING ELEMENT, DUAL-BAND DUAL-POLARIZED ANTENNA ASSEMBLY AND DUAL-POLARIZED ANTENNA ARRAY

This international patent application claims priority to prior U.S. application No. 60/943,612 filed on 13 Jun. 2007 and to prior EP-application No. 07011177 filed on 6 Jun. 2007. The entire disclosures of the aforesaid application numbers U.S. 60/943,612 and EP 07011177 are hereby incorporated by reference.

The present invention refers to a dual-polarized radiating element, to a dual-band dual-polarized antenna assembly and a dual-polarized antenna array.

Radiating elements, antenna assemblies and antenna arrays are known from antenna applications. Dual-polarized radiating elements, antenna assemblies or antenna arrays are known in order to provide radiation or to receive radiation in two different polarizations such that, due to the orthogonal polarizations, two separate communication channels are provided which can be used independently of each other at the same frequency.

Dual-polarized radiating elements are known e.g. being composed of dipole antennas.

Those dipoles are arranged in a cross dipole geometry. By selecting the appropriate opposite dipoles radiation in one or the other polarization can be emitted or received. Those dipoles are commonly provided at a distance of a quarter wavelength above a ground plane so that a wave emitted from the dipole in a forward direction interferes constructively with a wave emitted in the backward direction and which is reflected in the forward direction by the ground plane. Further dipoles require a balun transformer for a balanced signal.

The object of the present invention is to provide a dual-polarized radiating element having reduced dimensions and achieving acceptable radiation characteristics.

This object is solved for example by the dual-polarized radiating element of claim 1 or 20. Preferred embodiments are disclosed below.

The radiating element comprises two patches for radiating. The two patches may therefore be considered as patch antennas or the radiating element may be considered as a patch antenna with two patches.

Patch antennas are known for their low profile. Further they do not need a balun transformer. Nevertheless they also have certain drawbacks in certain radiation characteristics in comparison to dipoles.

Patch antennas are known, for example, by being provided on one surface of a dielectric substrate where on the other surface the ground plane is provided. For such patch antennas it is in principle, possible to have different geometries of the patch. In order to reduce the dimensions of a radiating element in comparison to the cross dipole configuration one could think of using a patch antenna which has a particular low profile. When trying to substitute a cross dipole with a patch with a cross geometry and two feeding ports, one considered for exciting radiation with one polarization and the other for exciting the other polarization, it however, turns out that it is particularly difficult to obtain two distinct linear orthogonal polarizations. In fact, often a mixture of linear and circular/elliptical polarization is achieved which is highly undesirable since such mixed radiation modes cannot be attributed to two distinct channels corresponding to orthogonal polarizations.

According to the present invention therefore, two patches are provided, each of them for one desired linear polarization and the patches are provided such that they overlap. This overlap can e.g. be seen in a view perpendicular to a plane in which one or the other patches extend, or in the view perpendicular to a ground plane (in case a common ground plane is provided). The plane for projection may also be defined by the plane in which the projection of the patches onto said plane has the largest surface. Such a plane may be useful for characterization of patches which are not entirely planar.

The two patches together preferably form a cross. This cross can be seen in particular in a view in which the overlap can be seen.

The patches can be electrically separated such that orthogonal polarizations are obtained and at the same time, reduced dimensions are achieved. Surprisingly it was found, that it is possible to have overlapping patches such that e.g. a cross geometry is preserved, which allows to have two orthogonal polarizations. Further the isolation between the two polarizations is good since no current can flow directly from one feeding port to another feeding port as is the case e.g. for a single patch which can be excited by two feeding ports.

For the purpose of this document, two polarizations are considered to be orthogonal in case that the planes of polarization are provided at an angle between 75° and 105°, preferably 80° and 100° and more preferably between 85° and 95° or even at 90°±2°. The plane of the polarization for a linear polarized radiation is given by the plane of the linear polarization and the direction of maximum radiation power emission of the antenna or the direction perpendicular to a ground plane while for elliptically polarized radiation the plane of polarization is understood to be the plane in which the long axis of the corresponding ellipse and the direction of maximum radiation power emission of the antenna or the direction perpendicular to a ground plane is situated. Slightly elliptical polarized radiation for the purpose of this document is also considered as linear polarized radiation as long as a minor axis of the corresponding ellipse is less than 20% or 10% or 5% of the major axis.

A radiating element may be provided with two or more feeding ports. Each feeding port is coupled to one of the two patches. A first feeding port excites a first polarization and a second feeding port excites a second polarization. The feeding port includes a ground channel that may be coupled to a ground plane and a primary channel coupled to the corresponding conducting patch. Each primary channel may comprise a pin or the like which is coupled to the first or second patch respectively. The primary channel may be conductively coupled, such as for instance soldered, to a patch. The coupling to the patches may also be capacitive or inductive. For a capacitive coupling, a coupling patch may be provided, for example, for the first patch on a level of the second patch and vice versa or on a third level wherein different levels are e.g. characterized by their distance to the ground plane. The coupling patch may have a polygonal shape or may at least in part be shaped by a line composed of straight and/or curved segments. The coupling patch is preferably in parallel to the corresponding patch. The primary channel is electrically conductively connected to a coupling patch. For connecting a coupling patch it may be required to have a hole in the patch to which the coupling patch is coupled e.g. for passing through a pin for the connection.

The region of overlap between the coupling patch and the patch behaves as a parallel plate capacitor, making it possible to feed the radiating element. By varying the extension of the region of overlap between the coupling patch and the patch and their distance of separation, the capacitive effect can be adjusted to, for example, cancel the parasitic inductive behavior of the conducting pin of the primary channel.

In some examples, it will be advantageous to place the coupling patch above the first patch, and coplanar to the second patch, because such a configuration allows for the coupling patch and the second patch to be implemented on a same side of a dielectric substrate, while the first patch can be implemented on the opposite side of said substrate, resulting in a mechanically simple solution.

In these examples, a through hole must be created in the first patch and the dielectric substrate to let the conducting pin of the primary channel of the first feeding port to contact the coupling patch without contacting the first patch.

Further, it is possible to provide a capacitive coupling by providing a capacitive gap in a conducting portion of the patch, said capacitive gap being provided in the same level as the patch and defining a capacitive island within the patch to which the primary channel is connected.

The capacitive coupling, independently of the configuration by which it is achieved may be designed such that the capacitance compensates the inductance of the primary channel such as e.g. the pin or any other conductive trace of the feeding port.

The first and/or second patch may be elongated. A patch may have for example, the shape of a rectangle, a rectangle with rounded corners, a bow tie shape, ellipse or the like.

Each patch has two points inside of the conductive area which have the largest separation between them. The line between those two points characterizes the largest extension of the patch. The two patches are preferably arranged in such a way that those two largest extensions of each patch are provided at an angle of preferably 90° or an angle of more than 85°, 80° or 75°. This is appropriate in order to achieve exactly or approximately orthogonal polarizations. This applies in particular, in case that the two patches have the same shape (they may have different sizes or the sizes may be equal). The patches are preferably arranged such that the two largest extensions cross each other, more preferably at their corresponding middle point or not further away of one middle point than 5%, 10% or 15% of the length of the largest extension. In case that, for symmetry reasons, there are two or more lines indicating the largest extension (e.g. two diagonals for a rectangle), the geometrically corresponding lines or the two lines with the smaller angle in between are taken into account. The geometrically corresponding lines are the ones that are situated close to each other and/or the most parallel ones after having placed one patch over the other by e.g. rotation or translation such that one patch best reflects the shape of the other patch.

Further, the patches may be characterized by their patch rectangles. The patch rectangle is given by the smallest size rectangle which entirely encloses the corresponding patch. In case that the patch is not provided in one plane, the patch rectangle is given by the projection of the patch onto the plane which is parallel to the ground plane or parallel to the major portion of the patch. The plane of projection maybe given by the plane in which the projection of the patch covers the largest area. The patch rectangle has at least one point in common on each of the four sides of the rectangle with the patch or the projection thereof.

Preferably the long edges of the two patch rectangles of the first and second patches are provided perpendicular or at least essentially perpendicular to each other. This includes the possibility of the long edges including an angle of more than 75°, 80° or 85°.

The long edges of the two patch rectangles may have the same length. Equally, the short edges may have the same length. The long edge of the patch rectangle may be approximately half of the free space operating wavelengths. More concretely, the long edges may have a length of less than 120%, 110% or 105% of the half of the free space operating wavelength and/or more than 85%, 90% or 95% thereof. The length of the long edges of the two patch rectangles may be equal or differ not more than 5%, 10% or 15% of the shorter of the two lengths. Equally, the length of the short edges of the two patch rectangles may be equal or differ not more than 5%, 10% or 15% of the shorter of the two lengths.

The free space operating wavelength is, for the purpose of this document, the wavelength of the radiation in free space, where the radiation has a frequency of the center frequency of the lowest operating frequency band of the corresponding item.

Furthermore, preferably the patch rectangle has a short edge which is less than 50% or 40% or 30% or 25% of the size of the long edge and more than 2%, 5%, 10% or 15% thereof. A small ratio between the size of the short edge and of the long edge is advantageous for maintaining much space for other items. A too small short edge, however, may result in an insufficient impedance bandwidth of the patch.

Furthermore, the space within the patch rectangle is preferably filled with a conductive area (or a projection thereof onto the plane of the rectangle) of the patch by at least 70%, 80% or 90% or more 95% or even up to 100% wherein the latter means that the patch or the projection has the rectangular shape.

Furthermore, the short edge of one of the first or second patch rectangles is preferably less than 40%, 30% or 25% of the long edge of the other patch rectangle and preferably more than 5%, 10%, 15% or 20% thereof.

Furthermore the radiating element may be described to have a radiating element rectangle. This is the smallest sized rectangle which completely encloses a projection of the two or more patches to a plane, which may be given by a plane parallel to one and/or the other patch or may be given by the plane of the ground plane or may be given by the plane in which a projection of the two of more patches is maximized. Preferably, this radiating element rectangle is a square which means that the edge ratio is 1. The ratio between the length of a shorter edge and of a longer edge of the radiating element rectangle may also be more than 80%, 90% or 95% or less than 120%, 115%, 110% or 105%.

Further, the longer edge or in case that those edges of the radiating element rectangle have the same size, any of the two edges may have the size of more than 80%, 85%, 90%, 95% of the half of the free space operating wavelengths and/or less than 120%, 115%, 110% or 105% thereof.

The radiating element rectangle may be filled up to 30%, 35%, 40%, 45%, or 50% and/or maybe filled more than 10%, 15%, 20%, 25%, 30% or 35% by the projection of the patches onto the plane of the radiating element rectangle. An upper limit is advantageous since it leaves space for other items such as other antennas, wiring, or the like. A certain degree of filling is however needed, in order for the antenna to have enough impedance bandwidth.

In some embodiments the area of overlap of the two patches in a projection to a plane as explained for the radiating element rectangle may be less than 35%, 30%, 25% or 20% of the area covered by one or the smaller of the two patches in that projection. The same relation and percentages may be given for the smallest rectangle or square which completely encloses the overlap area in that projection with respect to the size of one of the patches or the smaller patch or one of the patch rectangles or the smaller patch rectangle as mentioned above.

The overlap area or the smallest possible rectangle or square which completely encloses the overlap area may further have the size of at least 5%, 10%, 15% or 20% of one of the equal sized patches or of the smaller of the two patches or the patch rectangle of equal sized patch rectangles or of the smaller of the two patch rectangles.

The overlap area or the smallest possible rectangle or square completely enclosing the overlap area may have a size smaller than the upper limit of 10%, 8%, 6%, 5%, 4% or 3% and/or higher than a lower limit of 1%, 2%, 3%, 4%, 5% or 6% of the length of the edge of equal sized edges or of longest edge of the patch rectangles.

The separation between a ground plane and one of the two patches, may be between 3 mm and 6 mm. In general, of the space between the patch and the ground plane, preferably less than 50%, 40%, 30% or 20% is filled with a dielectric material while the remainder is air. Air in comparison to a dielectric material reduces losses.

In relation to the free space operating wavelengths of the radiating element, this separation between the patch and the ground plane is more than 1%, 2%, 4%, 6% or 8% of the free space operating wavelength and/or less than 2%, 4%, 6%, 8% or 10% thereof. This holds in particular in case that no parasitic elements are provided or that the separation between an electrically (i.e. actively) driven patch and the ground plane is considered.

In case that one or more parasitic elements (see below) are provided the separation between the ground plane and the patch which is most distanced from the ground plane is preferably more than 4%, 6%, 8%, 10%, 15% or 20% and/or less than 8%, 10%, 15%, 20% or 25% of the free space operating wavelength.

The two patches may be e.g. provided on two opposite sides of a dielectric substrate. In some cases, the vertical separation between the first and the second patches lying on opposite surfaces of a common dielectric substrate is less than 0.5, 1, 1.5, or 2 mm. The use of a thin dielectric substrate may be preferred to obtain patches of substantially the same size. They also may be on two sides facing each other of two different dielectric substrates. This provides the advantage that there is an air gap between the two patches which helps to reduce coupling between the patches. On the other hand providing two patches on opposite sides of a common dielectric substrate allows for a simple mechanical construction since only a small number of parts is needed.

In other cases, the vertical separation between the first and the second patches will be larger, which may be preferred in those cases in which higher isolation between polarizations is desired.

It is also possible that one or two or more of the patches are completely or partially given by rigid metal pieces. Those rigid metal pieces do not have or need any substrate which supports the conductive portion. This further provides the advantage that the radiation characteristics are not influenced by dielectric substrates provided in direct contact to the radiative portion.

The patch antennas may be provided with parasitic elements. Those parasitic elements may or may not have the same shape as that of their respectively corresponding electrically driven patch. The size of those elements however may be different. Such parasitic elements may be used for increasing the bandwidths of the radiating element, in particular if they have a slightly different resonance frequency which may be due to a different size and/or shape and/or separation from the ground plane in comparison to the corresponding electrically driven patch.

The parasitic element preferably is provided such that it overlaps entirely or at least partially with a corresponding patch and/or is parallel thereto but is separated in the vertical direction (direction extending perpendicular from the ground plane). The separation between the patch and the corresponding parasitic element is preferably more than 1, 1.5, 2, 2.5 or 3 times the separation between the patch and the ground plane and/or not more than 5.0, 4.5, 4.0 or 3.5 thereof. The separation between a parasitic element and the corresponding electrically driven patch is preferably between 6% and 10% of the free space operating wavelength Two parasitic elements may overlap each other. For the overlap the same possibilities apply as for the overlap (or overlap area) of the two (electrically directly driven) patches. Two parasitic elements may be provided giving a cross shape.

The patches or parasitic elements and/or their respective substrates may have holes. Those holes may be provided for example in their central portion. The same applies to the parasitic elements. It is advantageous to have holes in the center portion since this allows for a good mechanical support of the corresponding patch or substrate. On the other hand however, this does not significantly influence the currents in the patch or the parasitic elements since those currents in the center portion are usually not very high.

The patches or parasitic elements may be mechanically supported in relation to the ground plane by one or more dielectric post and/or one or more dielectric spacers or the like. It is advantageous to have on single fixing means such as a screw or clip means in order to fix the different parts since this allows for an simple mechanical construction.

Further, the separation between a conducting patch and the corresponding parasitic element and/or between two parasitic elements is preferably more than 2%, 4%, 6%, 8% or 10% of the free space operating wavelength and/or less than 15%, 12%, 10%, 8% or 6% of said free space operating wavelength.

By providing the first patch and the second patch at different heights over the ground plane, it is possible to excite two radiation modes having substantially linear polarizations oriented along two orthogonal directions: A first polarization is substantially aligned with the long edge of the first patch rectangle, and a second polarization substantially aligned with the long edge of the second patch rectangle.

Furthermore, providing the first patch and the second patch at different heights is advantageous to enhance the isolation between the two different polarizations, as coupling can only occur as a result of energy being electromagnetically coupled from one patch to the other, and no longer by means of electrical currents flowing from one feeding port to the other.

A further object of the present invention is to provide an antenna assembly for dual-polarized dual-band operation with reduced dimensions. Reduced dimensions are advantageous for combining different assemblies to an array, which needs further space for feeding networks etc. A simple stacking of different components, however, often leads to an undesired screening effect which makes such an approach not very recommendable. The above problem is solved by an antenna assembly according to claim 21 or 38 as disclosed in International Patent Application PCT/EP2008/004539 published as WO 2008/148569 A2. Preferred embodiments are disclosed below.

The band to which it is referred by the dual-band characteristic or any other frequency band referred to in this document is a frequency band which is defined as being a range of frequencies between a lower frequency and an upper frequency. The antenna assembly element, a radiating element, an antenna assembly or the antenna array operates or has to operate with a specified radio-electric performance within that frequency band. For example, the gain or the efficiency may be required to comply with certain specifications within a frequency band. The center frequency of a frequency band is defined as being the arithmetic mean between its lower frequency and its upper frequency.

For the antenna assembly, the center frequency of the second frequency band is preferably at least 1.5, 1.6, 1.7 or 1.8 times the center frequency of the first band and/or less than 2.5, 2.3, 2.1 or 2.0 of the center frequency of the first frequency band. With the second center frequency being approximately the double of the first center frequency, it is possible to group efficiently different elements of the antenna assembly together in a way that little space is required for the entire antenna assembly. In this way it may be possible to adjust one frequency band to a standardized frequency band which requires a license for operation while the other frequency band may be inside a free frequency range (where no license is required). A free choice of this other frequency band is therefore possible (within certain restrictions by standardized frequency bands). This choice allows for a geometrical configuration where different elements fit well into each other such that only little screening effects are observed while at the same time a very compact antenna is obtained.

For one, two or more frequency bands, a single antenna assembly element for radiating may be provided for each band. One antenna assembly element comprises one electrically driven element such as e.g. a patch or a dipole and may further comprise one, two or more associated parasitic elements. Such an antenna assembly element preferably has no further electrically driven element. Further for each polarization of one band a single antenna assembly element may be provided. It is also possible, that for two polarizations of one band one single antenna assembly element is provided.

It is further possible that one or two of the frequency bands are associated with a set of antenna assembly elements each. For the two polarizations of one band or the two bands a set of antenna assembly elements may be provided (for each band), wherein each antenna assembly element of that set is adapted to radiate in both polarizations.

All parts of an antenna assembly element of the first and/or second band may be patches. Patch antennas have certain limitations concerning their applications, however, do provide for the advantage of being relatively flat such that an antenna assembly with a low profile may be constructed. Surprisingly it turned out that even with only patch antennas (including parasitic elements) it is possible to set up a dual-band dual-polarized antenna assembly.

The use of patch antennas allows for a lower profile and mechanically simpler solution compared to other antenna assemblies making use of, for example, dipole antenna elements only or in part.

Radiation for one frequency band may be e.g. provided by a radiating element as mentioned above or below. Such a radiating element is a dual-polarized element with a first patch provided for radiating in a first polarization and a second patch provided for radiating in a second polarization which is essentially orthogonal to the first polarization and wherein the first patch and the second patch overlap. Such a radiating element is in particular, preferred for the first frequency band (the one with the lower operating frequency).

The set of antenna assembly elements given for providing radiation in the first (lower) frequency band may be given or comprise dipole antenna elements. The antenna assembly elements of the antenna assembly may be orthogonally projected onto a common ground plane. There exists a smallest rectangle or square which completely encloses the projections of the different antenna assembly elements.

The projection of the antenna assembly elements of the first band are preferably arranged close to and are preferably aligned, in parallel with the enclosing rectangle or square. This allows for a good use of the space provided for arranging different antenna assembly elements.

In some embodiments comprising dipole antenna elements, it is preferred to have two or more, or four or more dipole elements. They are preferred to be in parallel to a ground plane and/or to be separated from the ground plane by more than 10%, 15%, 20%, 25%, 30%, or 35% of the free space operating wavelength and/or less than 15%, 20%, 25%, 30%, 35%, 40% of the free space operating wavelength.

For each polarization, one antenna assembly element or two or three or four or more antenna assembly elements may be provided. All of those antenna assembly elements may have an orthogonal projection which is substantially close to, and aligned with respect to two opposite edges of the enclosing rectangle or square.

The antenna assembly elements corresponding to the first band and the antenna assembly elements corresponding to the second band have orthogonal projections onto a ground plane (which may be a common ground plane) which preferably do not overlap. The overlap may however also be less than 50%, 40%, 30%, 20%, 10% or 5% of the area of the orthogonal projection of the antenna assembly elements of the first band. This assures the avoidance of undesired screening effects and further decreases the coupling between antenna assembly elements of the different bands, and thus results in an enhanced radioelectric performance in each one of the two frequency bands. This is also advantageous for isolation between the different feeding ports of the different bands.

The rectangle or square enclosing all projections of all antenna assembly elements may have a longest edge smaller than 0.7, 0.75, 0.8, 0.85, 0.9, 1.0 or 1.1 times the free space operating wavelength of the lowest operating frequency band of the assembly.

The orthogonal projections onto the ground plane of the antenna assembly elements of the first band are enclosed within a first antenna assembly element rectangle. Further, the orthogonal projections of the antenna assembly elements of the second band are enclosed in a second antenna assembly element rectangle. Any of those rectangles may also be a square. Preferably, the second antenna assembly element rectangle is completely enclosed within the first antenna assembly element rectangle or vice versa. Thereby, it is possible to make the rectangle/square, which encloses projections of all antenna assembly elements of both bands, smaller than 0.5, 0.55, 0.6, 0.65 or 0.7 times the free space operating wavelength of the lower frequency band.

One antenna assembly element of the second band may be provided for providing one polarization and another antenna assembly element for providing the other polarization. It is however, also possible that one antenna assembly element is provided for providing both polarizations of the second band. Here, e.g. by different feeding points of that antenna assembly element, the two different polarizations can be achieved.

Any of the antenna assembly elements (such as the antenna assembly elements of the first band and/or of the second band) may have a complex geometry. Such complex geometries may be given by a patch having a perimeter, slot or an aperture which is shaped entirely or at least in a part as a space filling curve, a grid dimension curve, or a box counting curve or by a dipole being shaped, entirely or at least in part, by a space filling curve, a grid dimension curve, a box counting curve, or by a patch having a multilevel structure, or by a dipole having a multilevel structure.

In some examples, the transversal dimensions (i.e., the length and/or the width measured in a direction parallel to the ground plane) of the antenna assembly element of the second band is smaller than 0.7, 0.6 or 0.5 and/or larger than 0.3, 0.4 or 0.5 of the free space operating wavelength of the second (higher) frequency band center.

An antenna assembly element has a projection onto the ground plane. This projection has a geometrical shape which may be considered to have a center of gravity which refers to a point where the center of gravity lies for a corresponding shaped piece with uniform density. This center of gravity may be defined as the center of an antenna assembly element. This center may be outside of the antenna assembly element as e.g. given for a C-shaped antenna element. For a square or a rectangle, the center lies in the crossing point of two diagonals of the square or rectangle.

For the first or the second band more than one antenna assembly element may be provided and the spacing between the above defined centers of each antenna element of one band is preferably more than 0.5, 0.6, 0.7 or 0.8 times the free space operating wavelength and/or less than 1.1, 1.0 or 0.95 of the free space operating wavelength of the corresponding frequency band center. Such a spacing is advantageous for e.g. tailoring directivity, gain or side lobe suppression.

Further, the antenna assembly elements of the first and/or second band may comprise parasitic elements. The use of parasitic elements may be advantageous to increase the impedance bandwidth and/or enhance the radiation pattern of the antenna assembly in at least one of the first and second frequency bands or both and for at least one of the first and second polarizations or both. Such parasitic elements may be provided above or below to the electrically-driven antenna elements and parallel to them.

In a preferred embodiment parasitic elements of the second band are placed co-planar (in the same level) to an antenna assembly element of the first or second band, in particular co-planar to an electrically driven element. In this way, one and the same level provided by a dielectric substrate may be used for antenna assembly elements of different bands or even of the same band, resulting in a mechanically simple antenna assembly.

The set of antenna assembly elements of the second band may comprise one, two, three, four or more patch antenna elements and furthermore, each patch antenna element may be provided with one or more parasitic conducting patch elements. The vertical separation between the parasitic patch and the electrically driven conductive patch is preferably less than 6%, 8%, 10% or 12% of the free space operating wavelength of the second frequency band center and/or more than 1%, 2%, 3%, 4%, 5%, 6% and 8% or 10% thereof.

In a preferred embodiment the antenna assembly has two patches for providing radiation in two different (orthogonal) polarizations in a first (lower) frequency band and furthermore one, two, four or more patches for radiating in the second frequency band where each of those patches for radiating in the second frequency band is suitable for radiating in two orthogonal polarizations. The two patches of the first band are provided in a cross geometry and the (preferably four) patches of the second band are provided entirely or at least partially in the four empty corners of the cross geometry. This gives a particularly good use of the available space and hence a small device and at the same time screening effects are suppressed and sufficient isolation between different feeding ports and/or polarizations is achieved.

Antenna assembly elements provided for one and the same band and polarization may be provided with different feeding schemes. They may e.g. be provided with a different feeding port geometry. This leads to different phases of emitted radiation when provided with the same signal. In order to avoid destructive interference it is therefore advantageous to provide different feeding ports of the same band and frequency with a signal which is 180° phase shifted. This configuration leads to an improved isolation between different feeding ports.

A further object of the present invention is to provide an antenna array which is suitable for voice data and/or other data transmission, and particularly for high data transmission. Further the array is preferred to be small in size and if possible mechanically simple.

This problem is for example solved by an antenna array according to claim 39 or 40 as disclosed in International Patent Application PCT/EP2008/004539 published as WO 2008/148569 A2. Preferred embodiments are disclosed below.

The antenna array may radiate in at least two different (preferably orthogonal) polarizations independently of each other. The antenna array may be adapted to operate in two or more frequency bands, providing in each of said two or more frequency bands two different, preferably orthogonal, polarizations.

The antenna array may comprise 2, 3, 4, 5, 6, 9, 12, 16, 20, 24, 25, 30, 36 or more radiating elements as mentioned above or below or in the claims. The antenna array may comprise 2, 3, 4, 5, 6, 9, 12, 16, 20, 24, 25, 30, 36 or more antenna assemblies as mentioned above or below or in the claims.

The radiating elements or the antenna assemblies may be arranged in a 1 or 2-dimensional array.

By arranging assemblies each capable of operating in different frequency bands in an array a much smaller array is possible in comparison to two arrays next to each other, each array provided for one frequency band.

A spacing between radiating elements or antenna assemblies or the periodicity along one of the array axes may be more than 0.4, 0.5, 0.6, 0.7 and/or less than 1.1, 1.0, 0.9, 0.8, 0.7 or 0.6 times the free space operating wavelength of the center frequency of the corresponding frequency band or the lowest frequency band. Such values are suitable for obtaining a good directivity while avoiding the appearance of diffraction lobes.

The antenna array may comprise electrically driven patch antenna array elements which may be combined with parasitic elements. Each antenna array element preferably has only one electrically driven element and may have any number of associate parasitic elements. The antenna array may have a feeding and/or distribution network on the same layer as that of the electrically driven patches. This obviates the needs of via holes or the like in order to feed the electrically driven patches and therefore, reduces manufacturing costs. Preferably all of the electrically driven patches of one band are provided on this same layer. However, some of (e.g., half of) the electrically driven patches of that band may be on one or more other layers. Associated parasitic elements of the electrically driven patches may be on other layers as well without major problems, since they do not need an electric feeding. Parasitic elements may nevertheless be provided coplanar to the electrically driven patches as well. Patches of other bands may be on other layers as that of the above mentioned band.

The electrically driven patch antenna elements which are on the same level as that of the feeding and/or distribution network may have a complex shape (see space filling curve, etc.) such that they only require little space which provides more space available for the network. More space for the feeding and/or distribution network allows increasing the separation between the tracks of the network, or between the tracks and/or the electrically driven patch antenna elements minimizing the undesired coupling that may degrade the performance of the antenna array.

A ground plane layer may be provided below this network layer. The network layer above the ground plane is preferably the network layer for the antenna elements of the second (higher frequency) band. The indications "above" or "below" refer to a view where the back side of the antenna is facing downwards and the direction to which radiation is emitted (front side) is facing upwards.

A feeding and/or distribution network for operation of the first frequency band can be provided below or above the ground layer. It is preferably provided on the surface of a dielectric substrate where on the opposite side of the dielectric substrate, the ground plane is provided. The ground plane is preferably provided between the network layer of the first band and the network layer of the second band for isolation purposes.

Different layers of antenna patches, parasitic elements and/or feeding/distribution networks may be provided on the surfaces of different dielectric substrates. None of those dielectric substrates however, is preferably in direct contact, but preferably between two and/or at least two or three of the dielectric substrates an air gap is provided. E.g., an air gap of a dielectric substrate on which a feeding and/or distribution network is arranged is preferred since this effectively lowers the dielectric constant of such a substrate. This decreases the losses in the network and reduces the coupling between tracks of said network. A typical air gap is more than 0.2, 0.25, 0.3, 0.5 or 1.0 mm and/or less than 0.75, 1.0, 1.25, 1.5, 1.75 or 2.0 mm.

An antenna array may comprise two or more dielectric substrates which are common for all antenna array elements, radiating elements or antenna assemblies. Each of those may however, comprise 1, 2, 3 or more further individual dielectric substrates. It is thereby possible to reduce the amount of dielectric material in the volume close to the conductive elements which reduce losses. Some patches may be provided on a common dielectric substrate while some patches may be provided on individual dielectric substrates.

In the antenna array for one band the number of antenna array elements may be different in one and/or two directions of the array from the number of antenna array elements for the other band. It is for example possible, that in one direction of the array N antenna array elements are provided for the lower frequency band and in the same direction for the other band 2N-2, 2N-1 or 2N antenna array elements are provided. N may be more than 1, 2, 3, 4, 5, 6, 7, 8, 9, 10 or less than 3, 4, 5, 6, 7, 8, 9, 10 or 11. The antenna array element referred to here may be given by a patch (with or without parasitic element).

An antenna array may further comprise a metal plate which provides mechanical stability to the array and allows fixing of the array to a post or the like and furthermore, forms part of the protection against environmental influences. A distance of the metal plate to the closest dielectric substrate is preferably more than 0.2, 0.4, 0.5, 0.6, 0.8 or 1 mm and/or less than 0.5, 0.8, 1.0, 1.2 or 1.5 mm. The metal plate is preferably connected to ground. The metal plate is preferably treated, such as for instance coated or galvanized, to withstand typical environmental conditions.

A certain separation between the metal plate and the dielectric substrate is advantageous in order to maintain good electrical behavior of a feeding and/or distribution network which faces the metal plate.

The antenna array may further comprise a radome made of a dielectric (non-conducting) material which provides protection against environmental influences. Said radome may be closed by the above-mentioned metal plate. In an example, the radome of the antenna array is preferably made of a plastic and/or dielectric material (such as for instance, but not limited to, fiberglass, polycarbonate, acrylonitrile butadiene styrene or ABS, polyvinyl chloride or PVC, or others) and is substantially transparent to electromagnetic radiation within the frequency bands of operation of the antenna array in order to minimize losses.

The antenna array's thickness measured from the back side of the metal plate to the topmost portion of the radome is preferably less than 20%, 24%, 28%, 32% or 36% and/or more than 10%, 15% or 20% of the free space operating wavelength of the center frequency of the lowest arrays frequency band.

In any antenna array, one, two, three, four or more radiating elements, patches or antenna array elements may be provided which can be operated in 2, 3 or more frequency bands.

In particular a single-band dual-polarized array using the radiating elements mentioned above, below or in the claims may be provided. This array may have 9 radiating elements in a 3 by 3 arrangement. This gives a good trade-off between the requirement on the one hand for a small sized array which needs to be mounted on a post e.g. on a roof where strong winds may harm the array or the post and on the other hand of a certain degree of directivity such that e.g. a cell of a cellular antenna system can be served by the antenna, without interference to other cells. The total transversal size of the array may be 29 cm times 29 cm. The size may be smaller than 2.5 times the free space operating wavelength of the center frequency of the lower frequency band.

In general the size for an N by M array may be (N+0.5) times (M+0.5) the free space operating wavelength of the center frequency of the corresponding band. This relation applies to the two or more bands which means that the total transversal size complies with this restriction for both or more bands or this restriction applies only to the band with the lower frequency. N and M may be as indicated above for N and N may be the same or different from M.

The 3 by 3 array may further comprise 16 (4 by 4), 20 (4 by 5), 25 (5 by 5) or 36 antenna array elements of another band. This 3 by 3 array and the other antenna array elements may be located in an interwoven manner, which means that some antenna array elements of the one band are located in between antenna array elements of the other band.

The antenna array may have a maximum or minimum number of layers in which a dielectric substrate or dielectric substrates may be arranged. This maximum number may be 3, 4 or 5 and/or the minimum 2 or 3.

The array or the antenna assembly may comprise band pass filters in order to improve isolation between different bands at the I/O-connectors of the different bands.

The linear polarizations mentioned in this document preferably refer to a vertical and a horizontal polarization with respect to the surface of the earth (which is not to be confused with the electric ground mentioned before). Two linear polarizations may nevertheless also refer to two directions tilted ±45° with respect to the vertical.

In some examples, a feeding and distribution network may implement a uniform signal amplitude distribution among the antenna array elements that provide one polarization in a given frequency band of the antenna array. Such a choice of signal amplitude distribution may be preferred when a radiation pattern having a main lobe of narrow width is required.

In some other examples, a feeding and distribution network may implement a tapered amplitude split along one or two dimensions of an antenna array. Such a choice of signal amplitude distribution may be preferred when a radiation pattern having reduced secondary lobes is required.

In some examples, a feeding and distribution network implements a uniform phase distribution among the different antenna array elements that provide one polarization in a given frequency band of the antenna array.

In some other examples the feeding and distribution networks corresponding to different polarizations and/or to different frequency bands provide orthogonal phase distributions with respect to each other. The use of networks having orthogonal phase distribution is advantageous to reduce the coupling (and hence to increase the isolation) between the antenna array elements of different polarizations and/or different frequency bands.

In a preferred example feeding and distribution networks with orthogonal phase distributions are used to feed the antenna array elements of each of two orthogonal polarizations for a same frequency band, said frequency band being preferably the upper frequency band of the antenna array because of the larger number of antenna array elements and the smaller physical distance between them at that upper frequency band.

In an example, a feeding and distribution network advantageously comprises transmission lines and/or distributed circuit elements, said transmission lines and/or distributed circuit elements preferably using microstrip technology, or stripline technology.

In some embodiments, an antenna array comprises an independent feeding and distribution network for each frequency band and/or for each polarization.

In some other embodiments an antenna array comprises a feeding and distribution network for each polarization that is shared by more that one frequency band. In these cases, the antenna array may advantageously comprise a circuit module (such as for instance, but not limited to, a bank of band-pass filters, a duplexer, or a diplexer) to separate and/or combine the signals of the different frequency bands that share a same feeding and distribution network.

In some examples the antenna array may implement variable electrical tilt of the direction of the main lobe of its radiation pattern in at least one or two band(s) and/or in at least one or two polarization(s). In these cases the antenna array comprises a module to vary the phase distribution among the different antenna array elements that provide one polarization in a given frequency band of the antenna array.

In some embodiments according to the present invention, the patches (electrically driven/and/or parasitic) can be made of a layer of a conductive material (such as for instance copper) or alloy printed on, or backed with, a low-loss dielectric substrate (such as for instance, but not limited to, Taconic, FR4, Rogers, Arlon, or Neltec).

In other cases the patches/dipole elements can be made as a rigid or at least partially rigid piece of a conductive material or alloy (such as brass), and be fabricated by means of a process involving, for example, the steps of stamping, casting, or welding.

The antenna array can be adapted for indoor and/or outdoor applications. It may be suitable e.g. for access points or hotspots for e.g. wireless alarm systems.

Furthermore, the antenna array can be adapted for radio links between two or more base stations (e.g. of mobile telephone systems).

The antenna array may be used in a base station (such as a base station for mobile telephone services) for establishing wireless connectivity between different parts of a single base station. A portion of the base station installed on a mast and/or on a roof may be connected e.g. to another part of the base station installed (e.g. on the ground) in proximity of the mast or roof.

The present invention further relates to the aspect of providing an antenna array capable of transmitting large amounts of data over relatively short distances. This object is met by the antenna array adapted for operation in a frequency band within the 2.4 to 2.5 Gigahertz range and/or a frequency band within the 4.9 to 5.9 Gigahertz range. This is in particular advantageous for a dual-polarized antenna array.

A radiating element and/or an antenna assembly and/or an antenna array according to the present invention operates one, two, three or more cellular communication standards (such as for example GSM 850, GSM 900, GSM 1800, GSM 1900, UMTS, CDMA, W-CDMA, etc.), wireless connectivity standards (such as for instance WiFi, IEEE802.11 standards, Bluetooth, ZigBee, UWB, WiMAX, HSDPA, WiBro, or other high-speed standards), and/or broadcasts standards (such as for instance FM, DAB, XDARS, SDARS, DVB-H, DMB, T-DMB, or other related digital or analog video and/or audio standards).

Space Filling Curves

Figure 13:
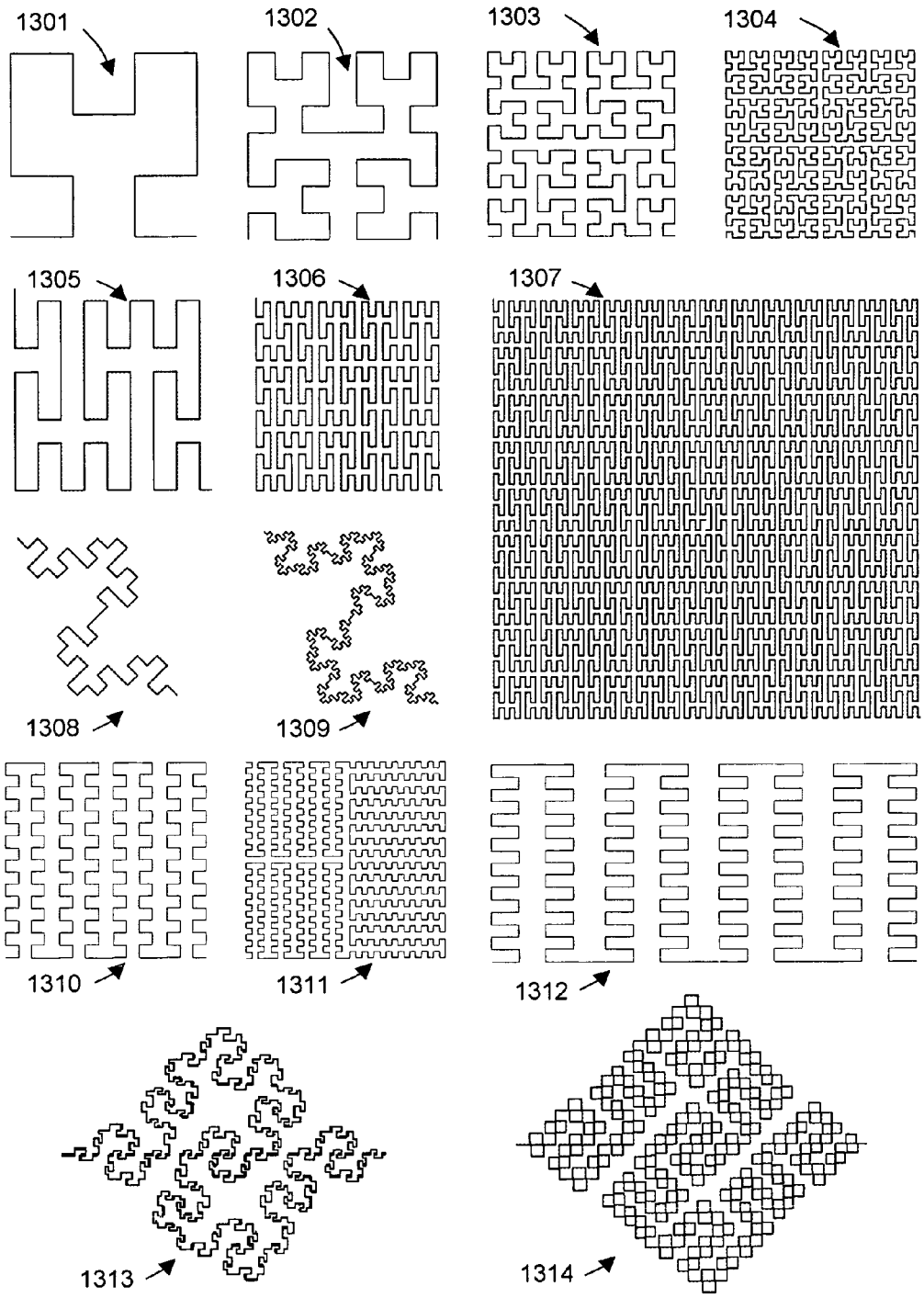

In some examples, a patch (electrically driven and/or parasitic) or a dipole element may be miniaturized by shaping at least a portion thereof (e.g., (a part) of an arm in a dipole or in a monopole, (part of) a perimeter, a slot or an aperture of the patch of a patch antenna, the slot in a slot antenna, the loop perimeter in a loop antenna or in a gap-loop antenna, or other portions of the antenna) as a space-filling curve (SFC). Examples of space filling curves (including for instance the Hilbert curve or the Peano curve) are shown in FIG. 13 (see curves 1301 to 1314). A SFC is a curve that is large in terms of physical length but small in terms of the area in which the curve can be included. Space filling curves fill the surface or volume where they are located in an efficient way while keeping the linear properties of being curves. In general space filling curves may be composed of straight, substantially straight and/or curved segments. More precisely, for the purposes of this patent document, a SFC may be defined as follows: a curve having at least a minimum number of segments that are connected in such a way that each segment forms an angle (or bend) with any adjacent segments, such that no pair of adjacent segments defines a larger straight segment. The bends between adjacent segments increase the degree of convolution of the SFC leading to a curve that is geometrically rich in at least one of edges, angles, corners or discontinuities, when considered at different levels of detail. In some cases, the corners formed by adjacent segments of the SFC may be rounded or smoothed. Possible values for the said minimum number of segments include 5, 6, 7, 8, 10, 12, 14, 16, 18, 20, 25, 30, 35, 40, 45 and 50. In addition, a SFC does not intersect with itself at any point except possibly the initial and final point (that is, the whole curve can be arranged as a closed curve or loop, but none of the lesser parts of the curve form a closed curve or loop).

A space-filling curve can be fitted over a flat surface, a curved surface, or even over a surface that extends in more than one plane, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. Moreover, in some further examples the segments of the SFCs should be shorter than at least one twentieth of the free-space operating wavelength. The space-filling curve should include at least five segments in order to provide some antenna size reduction; however a larger number of segments may be used, such as for instance 10, 15, 20, 25 or more segments. In general, the larger the number of segments and the narrower the angles between them, the smaller the size of the final antenna. An antenna shaped as a SFC is small enough to fit within a radian sphere (e.g., a sphere with a radius equal to the longest free-space operating wavelength of the antenna divided by 2π). However, the antenna features a resonance frequency lower than that of a straight line antenna substantially similar in size.

A SFC may also be defined as a non-periodic curve including a number of connected straight, substantially straight and/or curved segments smaller than a fraction of the longest operating free-space wavelength, where the segments are arranged in such a way that no adjacent and connected segments form another longer straight segment and wherein none of said segments intersect each other.

Alternatively, a SFC can be defined as a non-periodic curve comprising at least a minimum number of bends, wherein the distance between each pair of adjacent bends is shorter than a tenth of the longest free-space operating wavelength. Possible values of said minimum number of bends include 5, 10, 15, 20 and 25. In some examples, the distances between pairs of consecutive bends of the SFC are different for at least two pairs of bends. In some other examples, the radius of curvature of each bend is smaller than a tenth of the longest operating free-space wavelength.

Yet another definition of a SFC is that of a non-periodic curve comprising at least a minimum number of identifiable cascaded sections. Each section of the SFC forms an angle with other adjacent sections, and each section has a diameter smaller than a tenth of the longest free-space operating wavelength. Possible values of said minimum number of identifiable cascaded sections include 5, 10, 15, 20 and 25.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Preferably each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1310, 1311, 1312).

Box-Counting Curves

In other examples, the patch or the dipole may be miniaturized by shaping at least a portion thereof to have a selected box-counting dimension. For a given geometry lying on a surface, the box-counting dimension is computed as follows. First, a grid with rectangular or substantially squared identical boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this document, the box-counting dimension may be computed by placing the first and second grids inside a minimum rectangular area enclosing the conducting trace of the antenna and applying the above algorithm. The first grid in general has n×n boxes and the second grid has 2n×2n boxes matching the first grid. The first grid should be chosen such that the rectangular area is meshed in an array of at least 5×5 boxes or cells, and the second grid should be chosen such that L2=½ L1 and such that the second grid includes at least 10×10 boxes. The minimum rectangular area is an area in which there is not an entire row or column on the perimeter of the grid that does not contain any piece of the curve. Further the minimum rectangular area preferably refers to the smallest possible rectangle that completely encloses the curve or the relevant portion thereof.

An example of how the relevant grid can be determined is shown in FIGS. 14*a* to 14*c*. In FIG. 14*a* a box-counting curve is shown in it smallest possible rectangle that encloses that curve. The rectangle is divided in an n×n (here as an example 5×5) grid of identical rectangular cells, where each side of the cells corresponds to 1/n of the length of the parallel side of the enclosing rectangle. However, the length of any side of the rectangle (e.g., Lx or Ly in FIG. 14*b*) may be taken for the calculation of D since the boxes of the second grid (see FIG. 14*c*) have the same reduction factor with respect to the first grid along the sides of the rectangle in both directions (x and y direction) and hence the value of D will be the same no matter whether the shorter (Lx) or the longer (Ly) side of the rectangle is taken into account for the calculation of D. In some rare cases there may be more than one smallest possible rectangle. In this case the smallest possible rectangle giving the smaller value of D is chosen.

Alternatively the grid may be constructed such that the longer side (see left edge of rectangle in FIG. 14*a*) of the smallest possible rectangle is divided into n equal parts (see L1 on left edge of grid in FIG. 15*a*) and the n×n grid of squared boxes has this side in common with the smallest possible rectangle such that it covers the curve or the relevant part of the curve. In FIG. 15*a* the grid therefore extends to the right of the common side. Here there may be some rows or columns which do not have any part of the curve inside (see the ten boxes on the right hand edge of the grid in FIG. 15*a*). In FIG. 15*b* the right edge of the smallest rectangle (see FIG. 14*a*) is taken to construct the n×n grid of identical square boxes. Hence, there are two longer sides of the rectangular based on which the n×n grid of identical square boxes may be constructed and therefore preferably the grid of the two first grids giving the smaller value of D has to be taken into account.

If the value of D calculated by a first n×n grid of identical rectangular boxes (FIG. 14*b*) inside of the smallest possible rectangle enclosing the curve and a second 2n×2n grid of identical rectangular boxes (FIG. 14*c*) inside of the smallest possible rectangle enclosing the curve and the value of D calculated from a first n×n grid of squared identical boxes (see FIG. 15*a* or 15*b*) and a second 2n×2n grid of squared identical boxes where the grid has one side in common with the smallest possible rectangle, differ, then preferably the first and second grid giving the smaller value of D have to be taken into account.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve or the entire curve has a box-counting dimension larger than 1.1 may be referred to as box-counting curves.

Alternatively a curve may be considered as a box counting curve if there exists a first n×n grid of identical square or identical rectangular boxes and a second 2n×2n grid of identical square or identical rectangular boxes where the value of D is larger than 1.1, 1.15, 1.2, 1.25, 1.3, 1.35, 1.4, 1.5, 1.6, 1.7, 1.8, 1.9, 2.0, 2.1, 2.2, 2.3, 2.4, 2.5, 2.6, 2.7, 2.8, or 2.9.

In any case, the value of n for the first grid should not be more than 5, 7, 10, 15, 20, 25, 30, 40 or 50.

For very small antennas, for example antennas that fit within a rectangle having a maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The grid-dimension (D) may then be calculated using the above equation.

In general, for a given resonant frequency of the antenna, the larger the box-counting dimension, the higher the degree of miniaturization that will be achieved by the antenna.

One way to enhance the miniaturization capabilities of the antenna (that is, reducing size while maximizing bandwidth, efficiency and gain) is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid. The relevant grid here may be any of the above mentioned constructed grids or may be any grid. That means if any 5×5 grid exists with the curve crossing at least 14 boxes or crossing one or more boxes twice the curve may be said to be a box counting curve.

Figure 12:
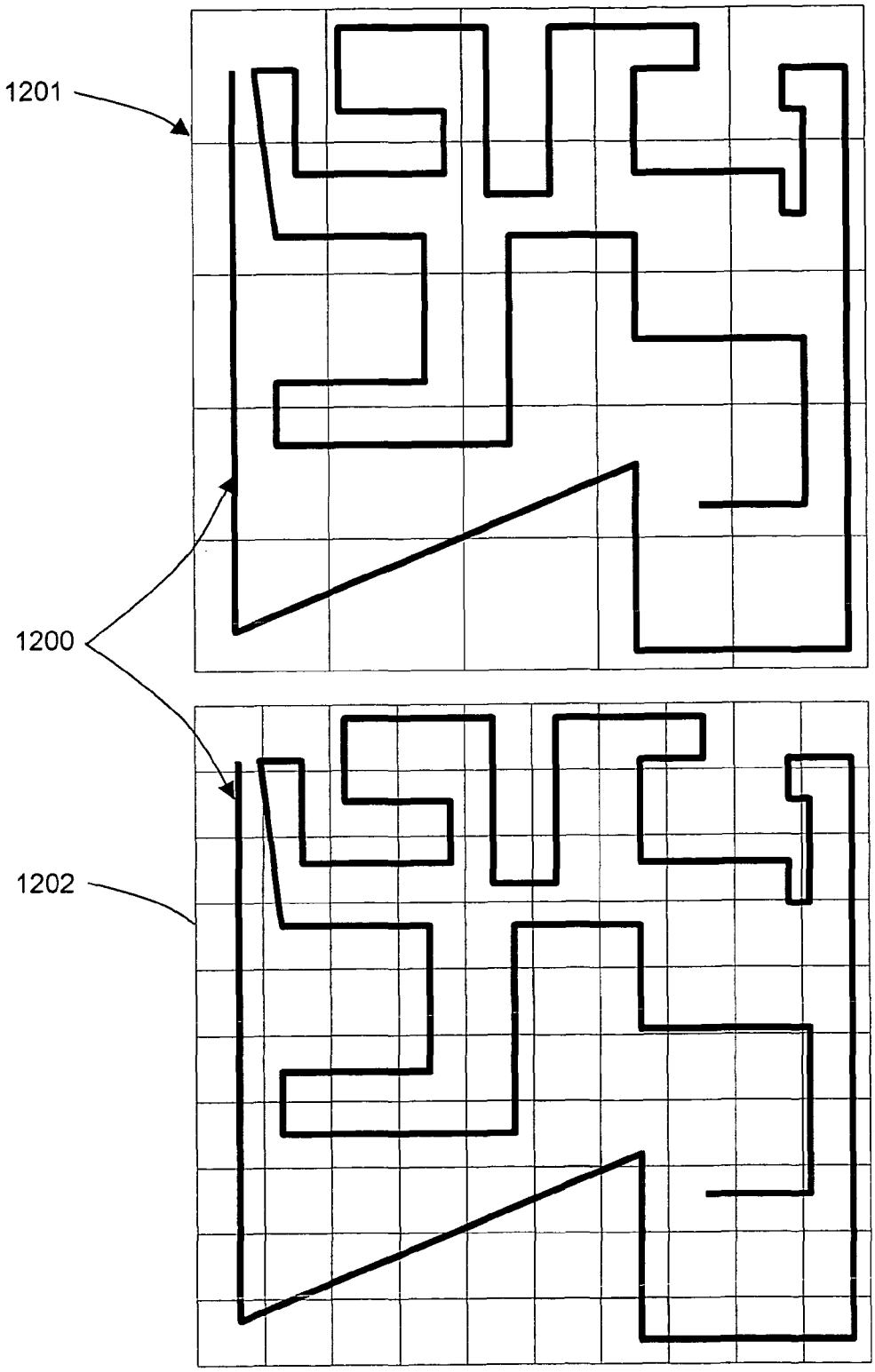

FIG. 12 illustrates an example of how the box-counting dimension of a curve 1200 is calculated. The example curve 1200 is placed under a 5×5 grid 1201 (FIG. 12 upper part) and under a 10×10 grid 1202 (FIG. 12 lower part). As illustrated, the curve 1200 touches N1=25 boxes in the 5×5 grid 1201 and touches N2=78 boxes in the 10×10 grid 1202. In this case, the size of the boxes in the 5×5 grid 2 is twice the size of the boxes in the 10×10 grid 1202. By applying the above equation, the box-counting dimension of the example curve 1200 may be calculated as D=1.6415. In addition, further miniaturization is achieved in this example because the curve 1200 crosses more than 14 of the 25 boxes in grid 1201, and also crosses at least one box twice, that is, at least one box contains two non-adjacent segments of the curve. More specifically, the curve 1200 in the illustrated example crosses twice in 13 boxes out of the 25 boxes.

The terms explained above can be also applied to curves that extend in three dimensions. If the extension in the third dimension is rather small the curve will fit into an n×n×1 arrangement of 3D-boxes (cubes of size L1×L1×L1) in a plane. Then the calculations can be performed as described above. Here the second grid will be a 2n×2n×1 grid of cuboids of size L2×L2×L1.

If the extension in the third dimension is larger an n×n×n first grid and a 2n×2n×2n second grid will be taken into account. The construction principles for the relevant grids as explained above for two dimensions apply equally in three dimensions.

Grid Dimension Curves

In yet other examples, the patch or dipole may be miniaturized by shaping at least a portion thereof to include a grid dimension curve. For a given geometry lying on a planar or curved surface, the grid dimension of the curve may be calculated as follows. First, a grid with substantially square identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal preferably square cells. The second grid may, for example, be chosen such that each cell of the first grid is divided in 4 equal cells, such that the size of the new cells is L2=½ L1, and the second grid includes at least 100 cells.

Depending on the size and position of the squares of the grid the number of squares of the smallest rectangular may vary. A preferred value of the number of squares is the lowest number above or equal to the lower limit of 25 identical squares that arranged in a rectangular or square grid cover the curve or the relevant portion of the curve. This defines the size of the squares. Other preferred lower limits here are 50, 100, 200, 250, 300, 400 or 500. The grid corresponding to that number in general will be positioned such that the curve touches the minimum rectangular at two opposite sides. The grid may generally still be shifted with respect to the curve in a direction parallel to the two sides that touch the curve. Of such different grids the one with the lowest value of D is preferred. Also the grid whose minimum rectangular is touched by the curve at three sides (see as an example FIGS. 15*a* and 15*b*) is preferred. The one that gives the lower value of D is preferred here.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 may be referred to as a grid dimension curve. In some cases, a grid dimension curve will feature a grid dimension D larger than 1.1, 1.15, 1.2, 1.25, 1.3, 1.35, 1.4, 1.5, 1.6, 1.7, 1.8, 1.9, 2.0, 2.1, 2.2, 2.3, 2.4, 2.5, 2.6, 2.7, 2.8, or 2.9.

In general, for a given resonant frequency of the antenna, the larger the grid dimension the higher the degree of miniaturization that will be achieved by the antenna.

One example way of enhancing the miniaturization capabilities of the antenna is to arrange the several segments of the curve of the antenna pattern in such a way that the curve intersects at least one point of at least 50% of the cells of the first grid with at least 25 cells (preferably squares) enclosing the curve. In another example, a high degree of miniaturization may be achieved by arranging the antenna such that the curve crosses at least one of the cells twice within the 25 cell grid (of preferably squares), that is, the curve includes two non-adjacent portions inside at least one of the cells or cells of the grid. In general the grid may have only a line of cells but may also have at least 2 or 3 or 4 columns or rows of cells.

Figure 16:
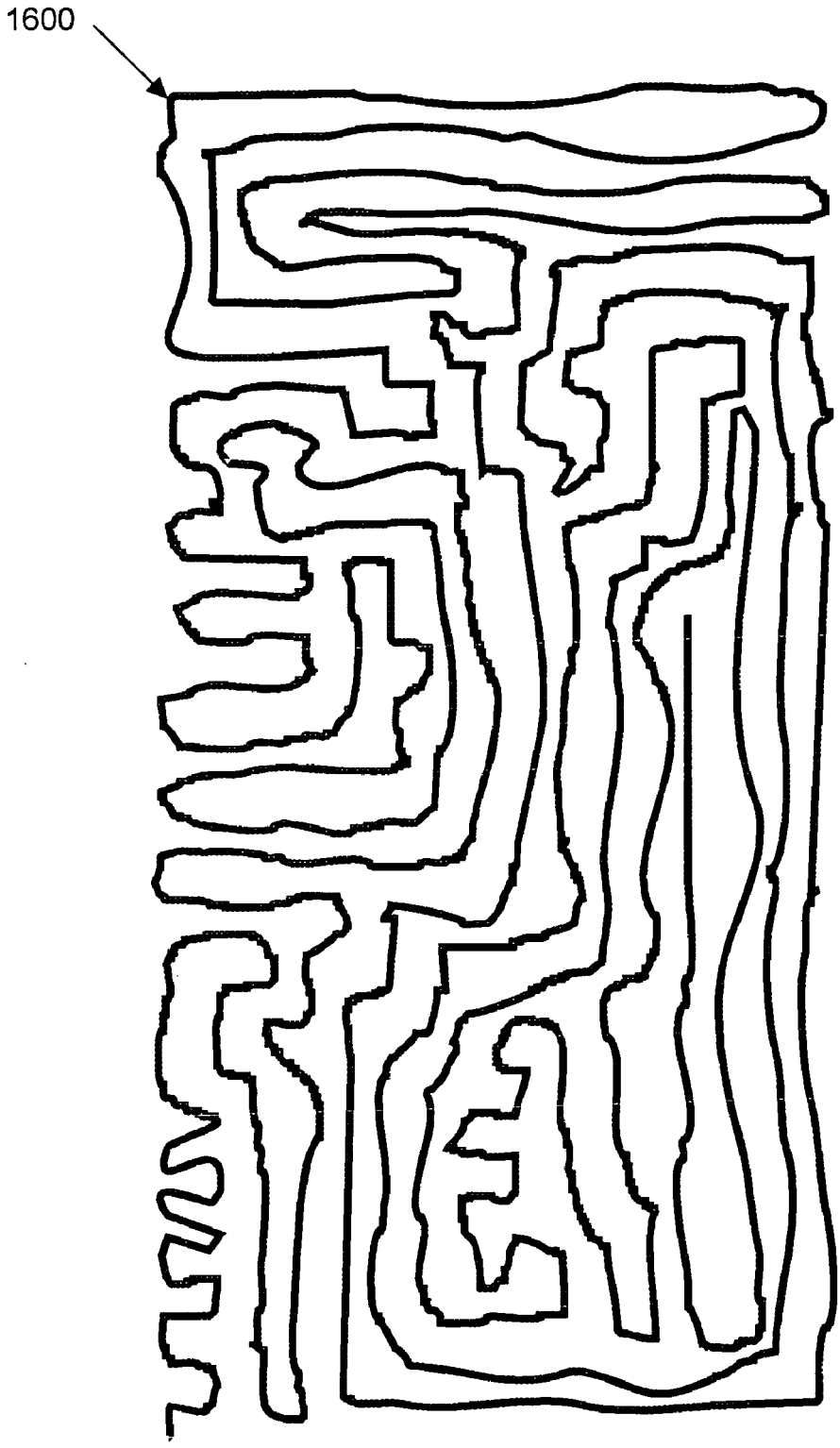
Figure 17:
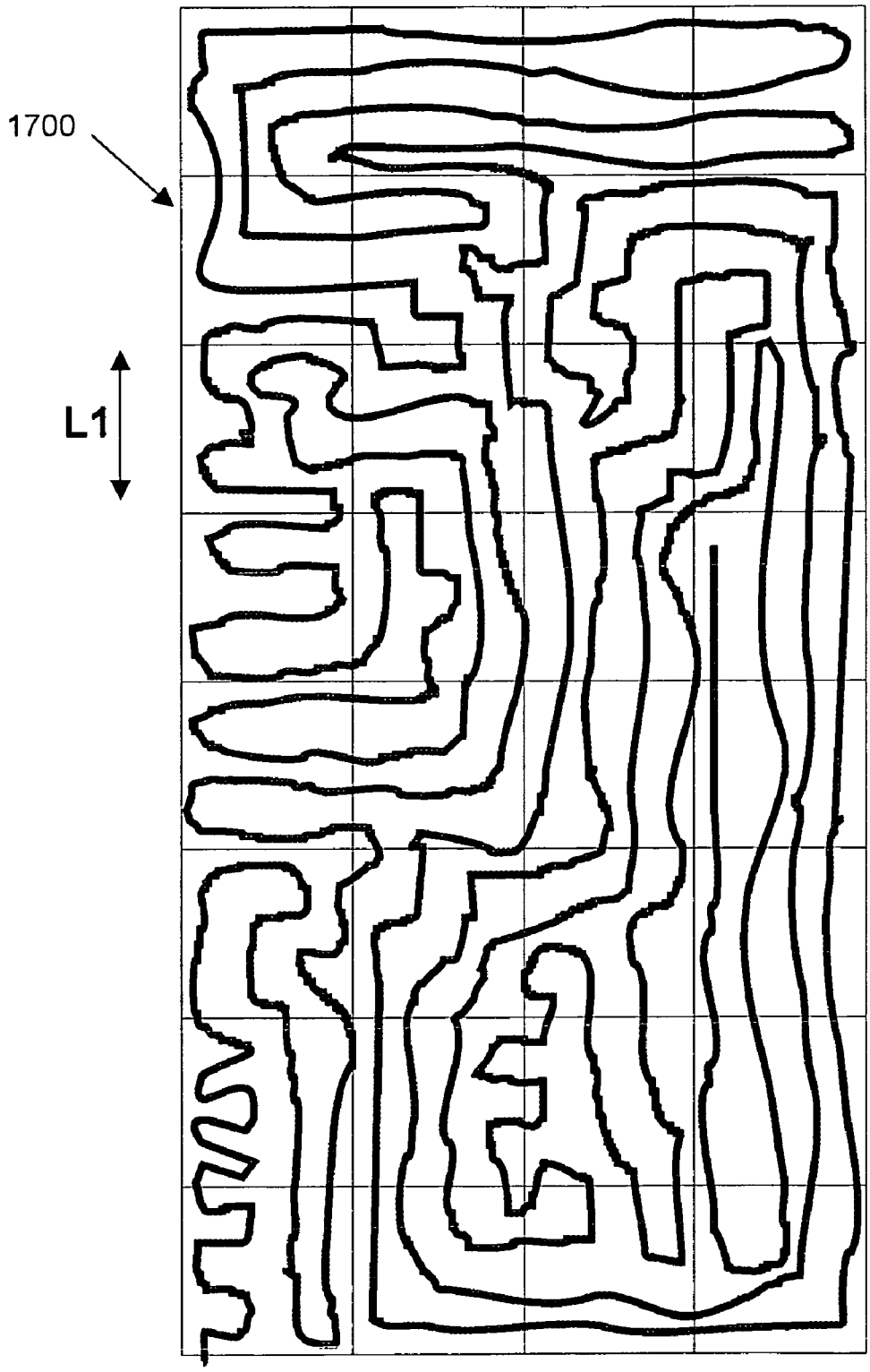
Figure 18:
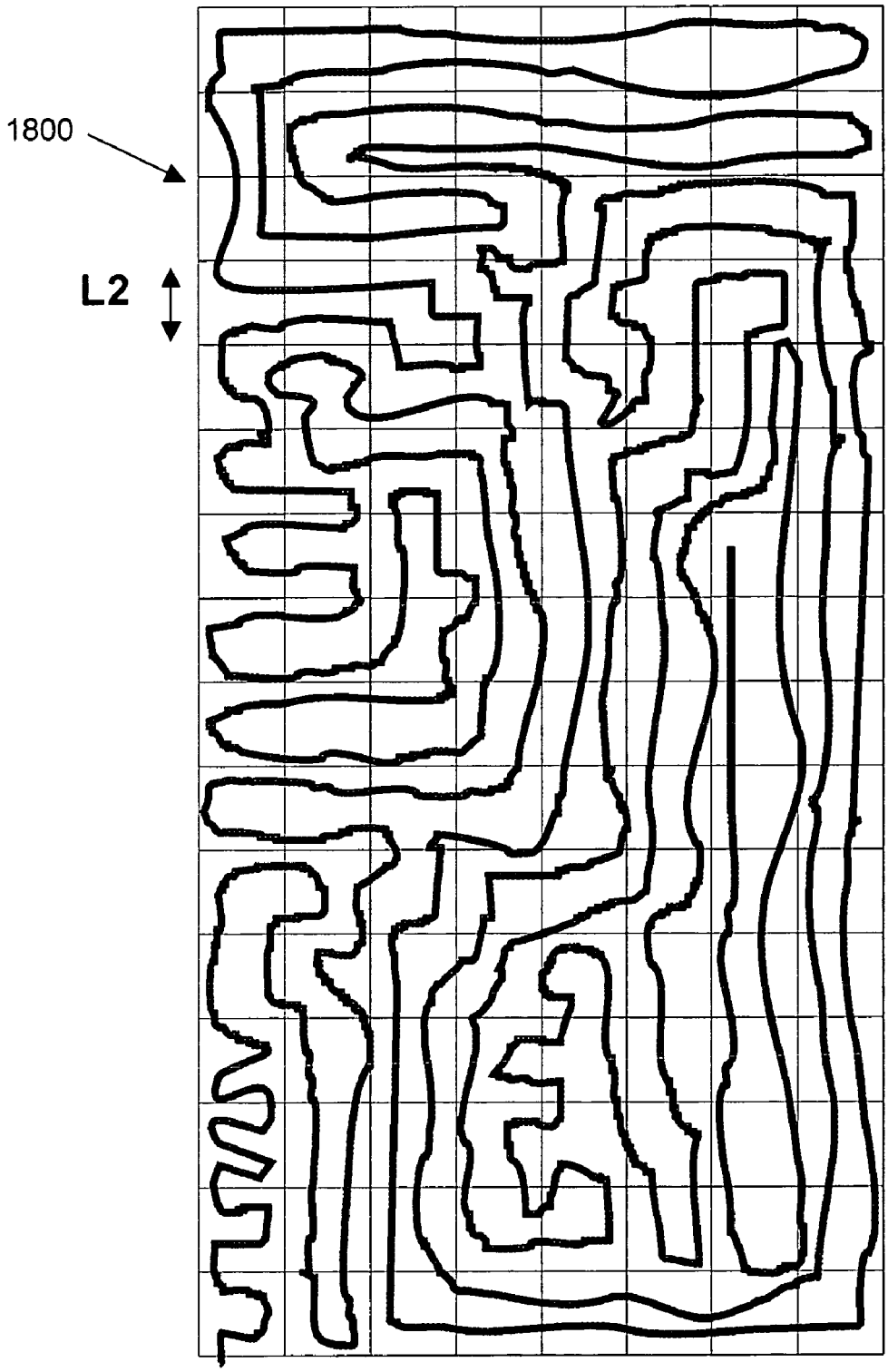

FIG. 16 shows an example two-dimensional antenna forming a grid dimension curve with a grid dimension of approximately two. FIG. 17 shows the antenna of FIG. 16 enclosed in a first grid having thirty-two (32) square cells, each with a length L1. FIG. 18 shows the same antenna enclosed in a second grid having one hundred twenty-eight (128) square cells, each with a length L2. The length (L1) of each square cell in the first grid is twice the length (L2) of each square cell in the second grid (L1=2×L2). An examination of FIG. 17 and FIG. 18 reveals that at least a portion of the antenna is enclosed within every square cell in both the first and second grids. Therefore, the value of N1 in the above grid dimension ($D_g$) equation is thirty-two (32) (i.e., the total number of cells in the first grid), and the value of N2 is one hundred twenty-eight (128) (i.e., the total number of cells in the second grid). Using the above equation, the grid dimension of the antenna may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 19:
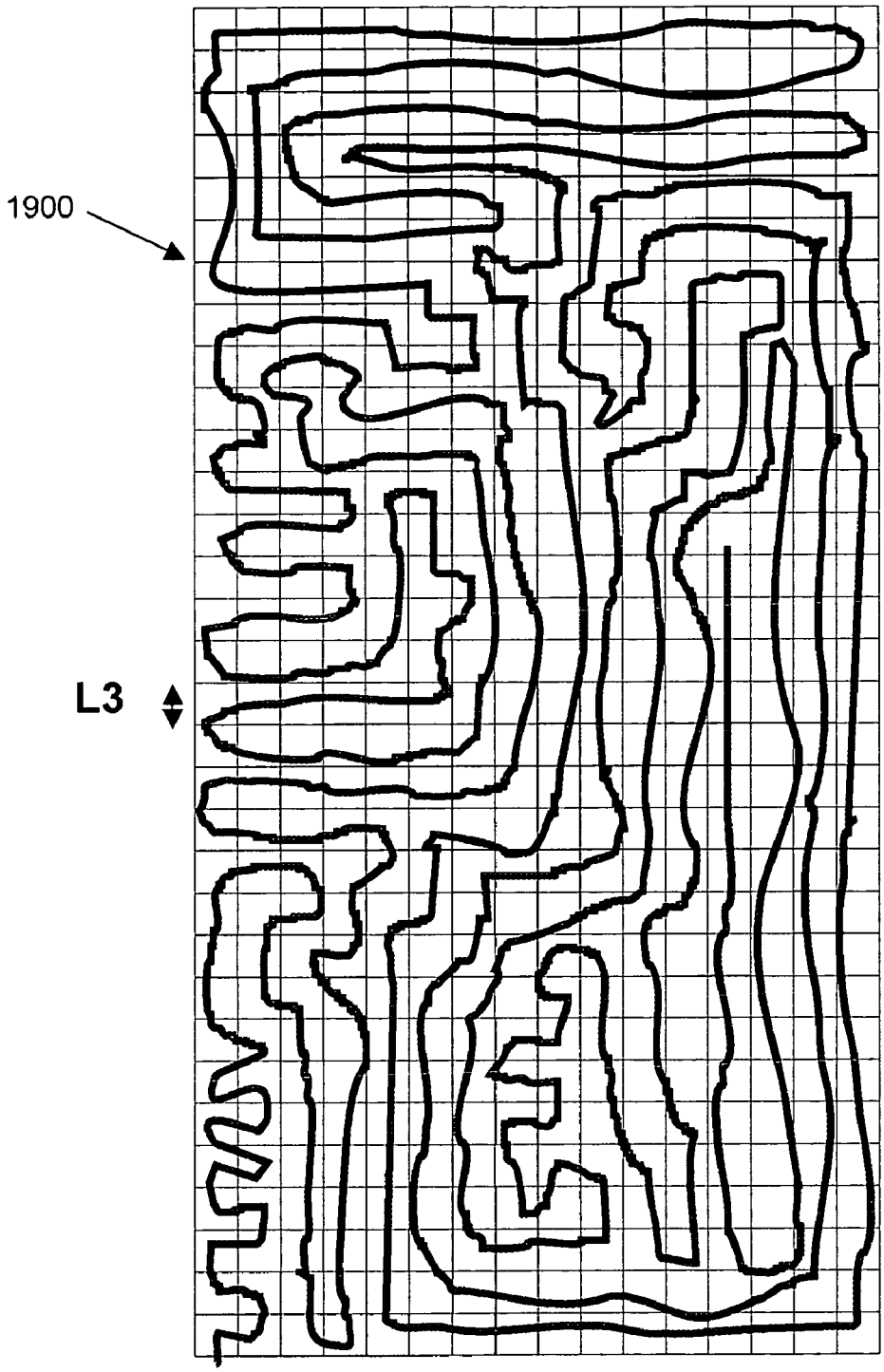

For example, FIG. 19 shows the same antenna as of FIG. 16 enclosed in a third grid with five hundred twelve (512) square cells, each having a length L3. The length (L3) of the cells in the third grid is one half the length (L2) of the cells in the second grid, shown in FIG. 18. As noted above, a portion of the antenna is enclosed within every square cell in the second grid, thus the value of N for the second grid is one hundred twenty-eight (128). An examination of FIG. 19, however, reveals that the antenna is enclosed within only five hundred nine (509) of the five hundred twelve (512) cells of the third grid. Therefore, the value of N for the third grid is five hundred nine (509). Using FIG. 18 and FIG. 19, a more accurate value for the grid dimension ($D_g$) of the antenna may be calculated as follows:

$$D_g = -\frac{\log(509) - \log(128)}{\log(2 \times L2) - \log(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 16).

The terms explained above can be also applied to curves that extend in three dimensions. If the extension in the third dimension is rather small the curve will fit into an arrangement of 3D-boxes (cubes) in a plane. Then the calculations can be performed as described above. Here the second grid will be composed in the same plane of boxes with the size L2×L2×L1.

If the extension in the third dimension is larger an m×n×o first grid and a 2m×2n×2o second grid will be taken into account. The construction principles for the relevant grids as explained above for two dimensions apply equally in three dimensions. Here the minimum number of cells preferably is 25, 50, 100, 125, 250, 400, 500, 1000, 1500, 2000, 3000, 4000 or 5000.

Multilevel Structures

In another example, at least a portion of the patch or the dipole or the entire patch or dipole may be coupled, either through direct contact or electromagnetic coupling, to a conducting surface, such as a conducting polygonal or multilevel surface. Further, a patch or dipole may include or be given entirely by the shape of a multilevel structure. A multilevel structure is formed by gathering several identifiable geometrical elements such as polygons or polyhedrons of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements.

At least two of the elements may have a different size. However, also all elements may have the same or approximately the same size. The size of elements of a different type may be compared by comparing their largest diameter. The polygons or polyhedrons of a multilevel structure may comprise straight, flat and/or curved peripheral portions. Some polygons or polyhedrons may have perimeter portions comprising portions of circles and/or ellipses.

The majority of the component elements of a multilevel structure have more than 50% of their perimeter (for polygons) or of their surface (for polyhedrons) not in contact with any of the other elements of the structure. In some examples, the said majority of component elements would comprise at least the 50%, 55%, 60%, 65%, 70% or 75% of the geometric elements of the multilevel structure. Thus, the component elements of a multilevel structure may typically be identified and distinguished, presenting at least two levels of detail: that of the overall structure and that of the polygon or polyhedron elements which form it. Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons. The elements (polygons or polyhedrons) are identifiable by their exposed edges and, when there is contact or overlapping between elements, by the extension of their exposed edges (such as for example through projection) into said region of contact or overlapping.

One example property of a multilevel antenna is that the radioelectric behavior of the antenna can be similar in more than one frequency band. Antenna input parameters (e.g., impedance) and radiation patterns remain substantially similar for several frequency bands (i.e., the antenna has the same level of impedance matching or standing wave relationship in each different band), and often the antenna presents almost identical radiation diagrams at different frequencies. Such a property allows the antenna to operate simultaneously in several frequencies, thereby being able to be shared by several communication devices. The number of frequency bands is proportional to the number of scales or sizes of the polygonal elements or similar sets in which they are grouped contained in the geometry of the main radiating element.

In a multilevel antenna operating in several frequency bands, different subsets of geometrical elements of the multilevel structure are associated with the different frequency bands of the antenna. In some cases for example, the overall structure can be responsible for one frequency, and different subsets of geometrical elements within the structure be responsible for other frequency bands. In some examples, a first subset of geometrical elements can comprise at least some of the geometrical elements of a second subset, while in other cases the first subset may comprise a majority of the geometrical elements of the second subset (i.e., the second subset is substantially within the first subset).

In addition to their multiband behavior, multilevel structure antennae may have a smaller than usual size as compared to other antennae of a simpler structure (such as those consisting of a single polygon or polyhedron) operating at the same frequency. The empty spaces defined within the multilevel structure provide a long and winding path for the electrical currents, making the antenna resonate at a lower frequency than that of a radiating structure not including said empty spaces. Additionally, the edge-rich and discontinuity-rich structure of a multilevel antenna may enhance the radiation process, relatively increasing the radiation resistance of the antenna and/or reducing the quality factor Q (i.e., increasing its bandwidth).

A multilevel antenna structure may be used in many antenna configurations, such as dipoles, monopoles, patch or microstrip antennae, coplanar antennae, reflector antennae, aperture antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

LIST OF FIGURES

Embodiments of the invention are shown in the enclosed figures. Herein shows:

FIG. 1—Example of a dual-polarized radiating element having a cross-shaped geometry according to the present invention: (a) Perspective view; (b) top plan view; and (c) cross-sectional view.

Figure 1B:
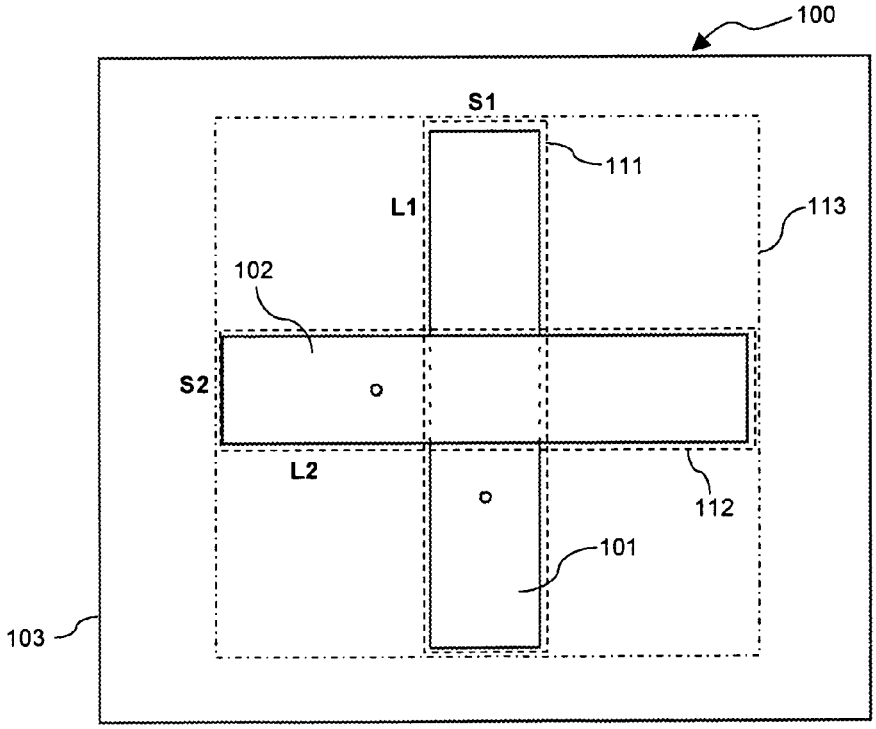
Figure 1C:
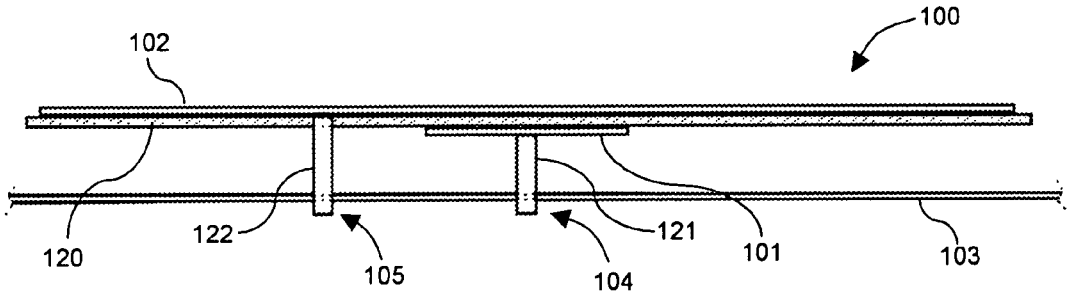
Figure 2:
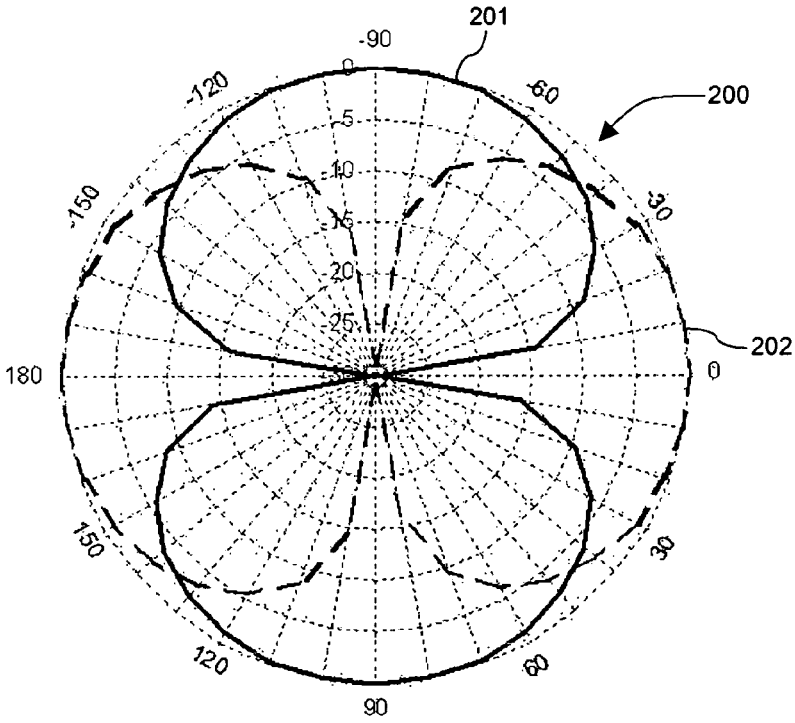

FIG. 2—Typical polarization pattern of the dual-polarized radiating element of FIG. 1.

FIG. 3—Example of a dual-polarized radiating element having a cross-shaped geometry comprising parasitic elements according to the present invention: (a) Assembled view; and (b) exploded view of the structure showing its constructive parts.

Figure 3A:
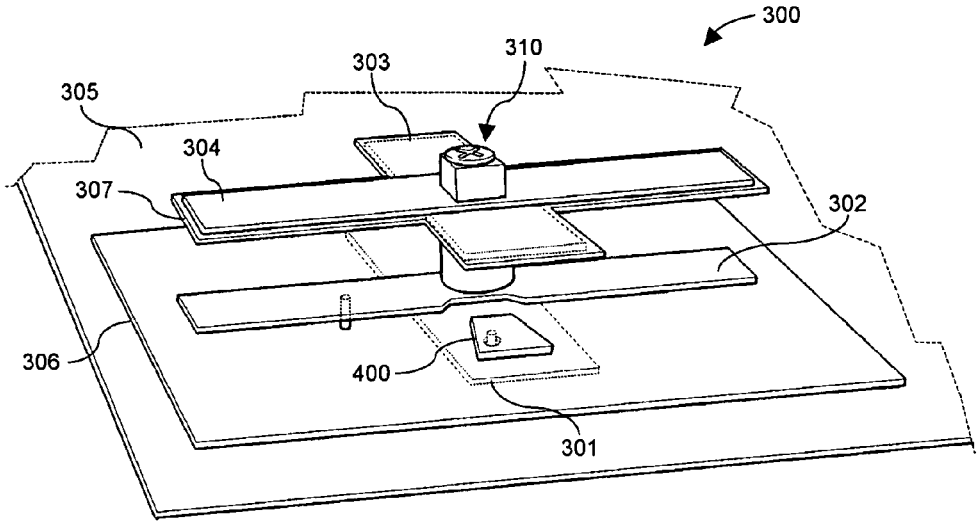
Figure 3B:
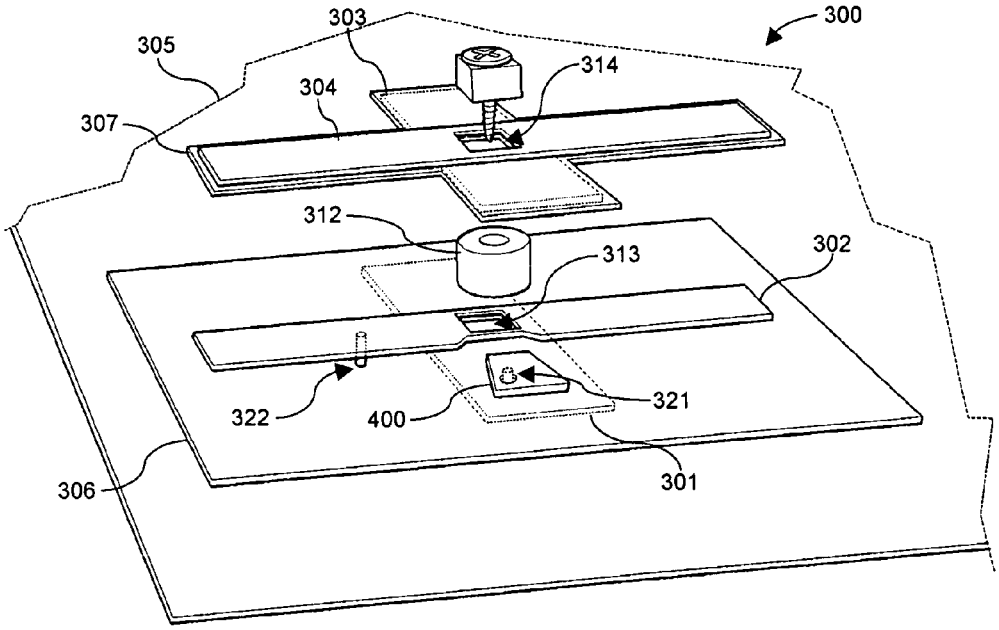
Figure 4:
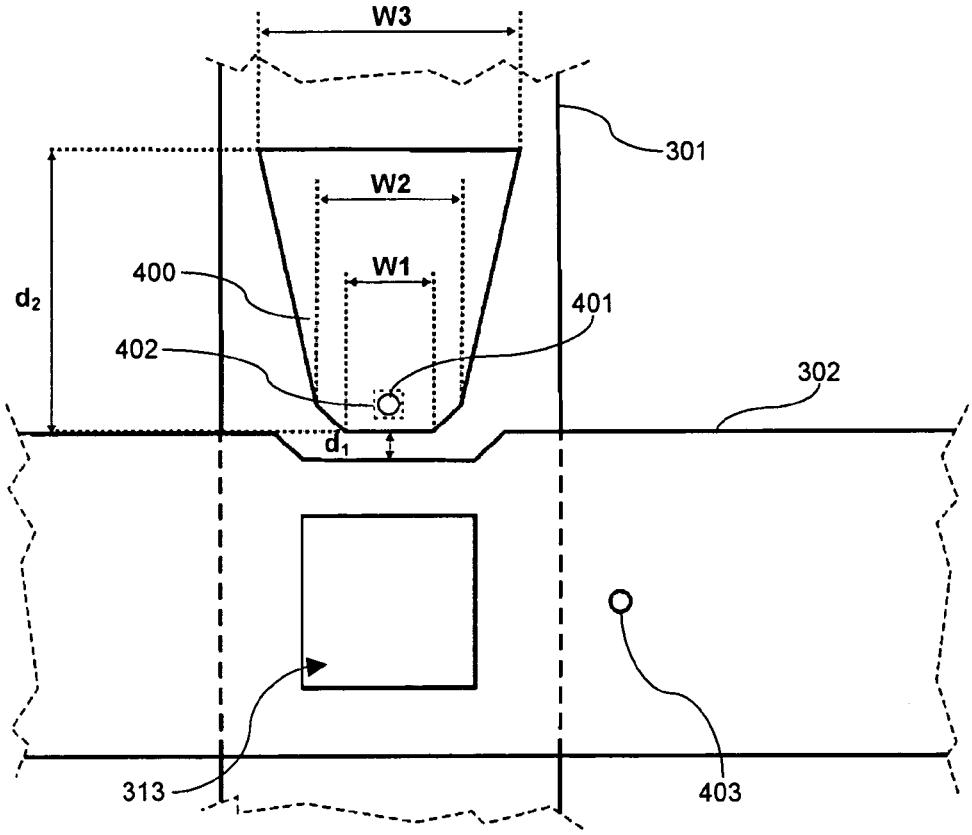

FIG. 4—Detailed view of the dual-polarized radiating element of FIG. 3 showing the capacitive means used to couple a feeding port to a conducting patch of said radiating element.

FIG. 5—Example of a dual-band dual-polarized antenna assembly comprising a dual-polarized radiating element having a cross-shaped geometry: (a) Perspective view; (b) top plan view; (c) cross-sectional view; and (d) exploded view of the structure showing its constructive parts.

FIG. 6—Another example of a dual-band dual-polarized antenna assembly comprising a dual-polarized radiating element having a cross-shaped geometry: (a) Perspective view; and (b) top plan view.

Figure 7A:
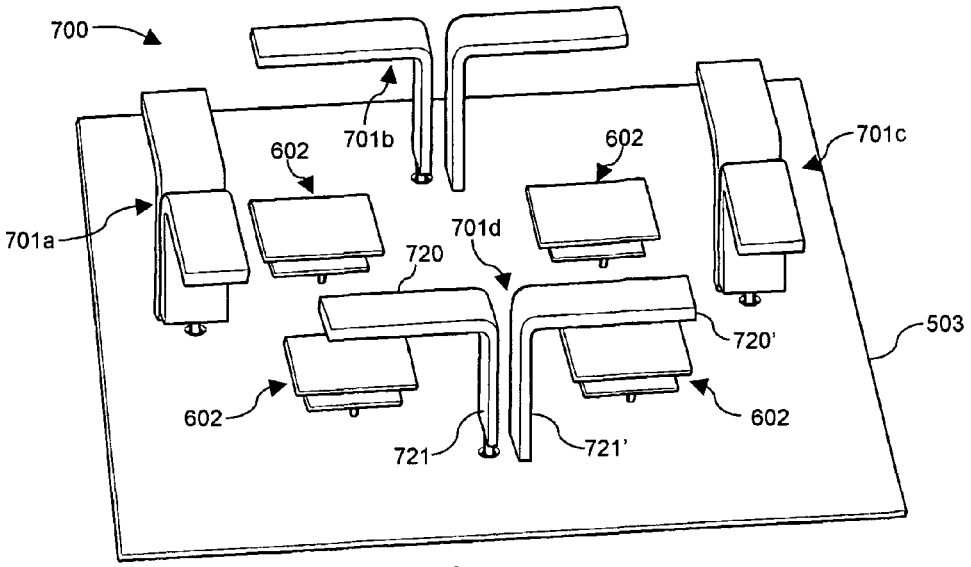

FIG. 7—Example of a dual-band dual-polarized antenna assembly according to the present invention comprising dipole antenna elements operating in a first frequency band and patch antenna elements operating in the second frequency band: (a) Perspective view; and (b) top plan view.

FIG. 8—Another example of a dual-band dual-polarized antenna assembly according to the present invention comprising dipole antenna elements operating in a first frequency band and patch antenna elements operating in the second frequency band: (a) Perspective view; and (b) top plan view.

FIG. 9—Example of a dual-band dual-polarized antenna assembly according to the present invention comprising a first set of patch antenna elements operating in a first frequency band and second set of patch antenna elements operating in the second frequency band (including a total of eight antenna assembly elements): (a) Perspective view; and (b) top plan view.

Figure 10:
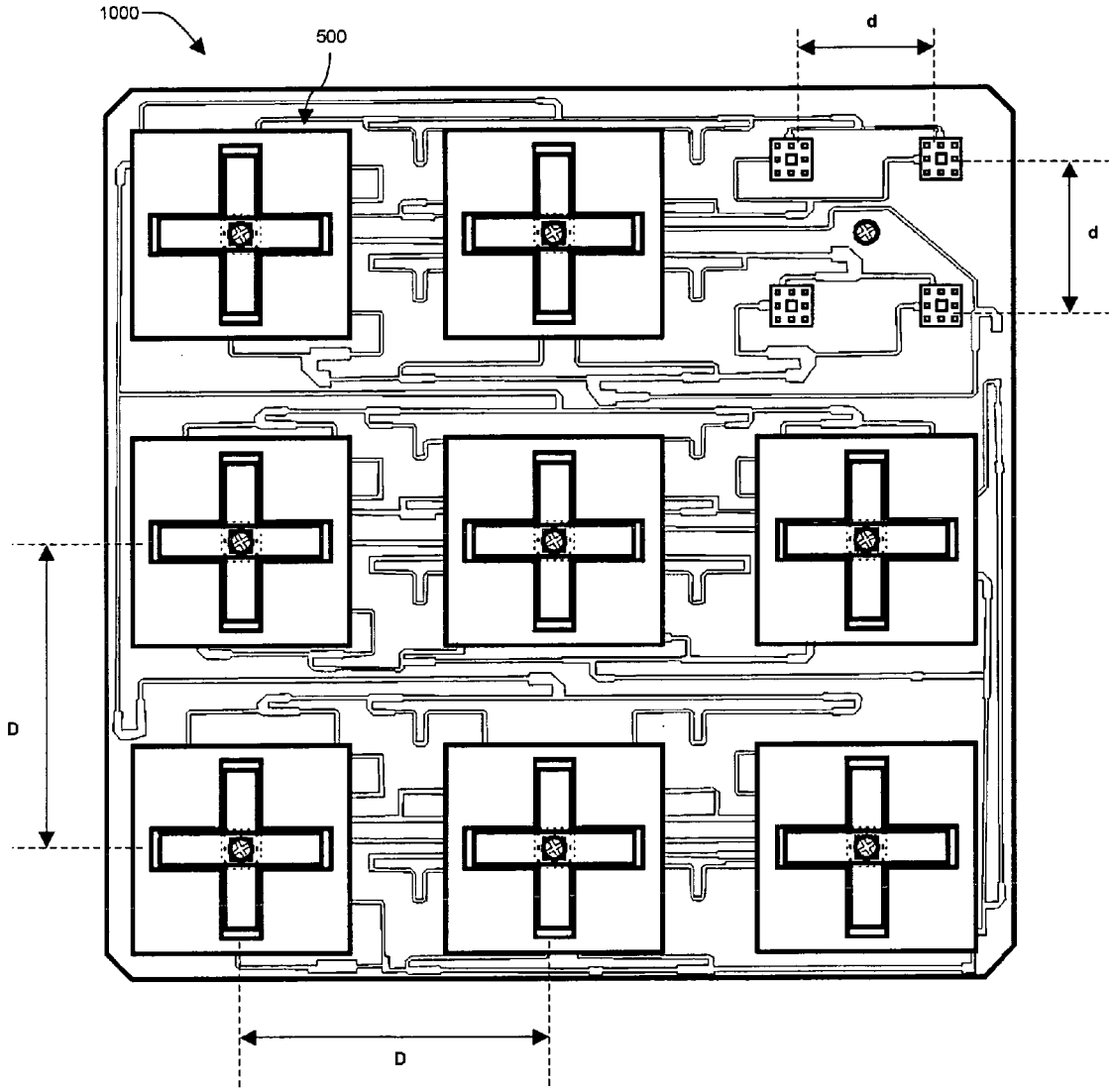

FIG. 10—Top plan view of an example (dual-band) dual-polarized antenna array according to the present invention, the array comprising a 3-by-3 arrangement of dual-band dual-polarized antenna assemblies.

FIG. 11—Partial perspective view of the (dual-band) dual-polarized antenna array of FIG. 10 focusing on an antenna assembly close to a corner of the antenna array: (a) Assembled view; and (b) exploded view of the structure showing the constructive layers of the antenna array.

FIG. 12—Example of how to calculate the box counting dimension.

FIG. 13—Examples of space filling curves for antenna design.

Figure 14:
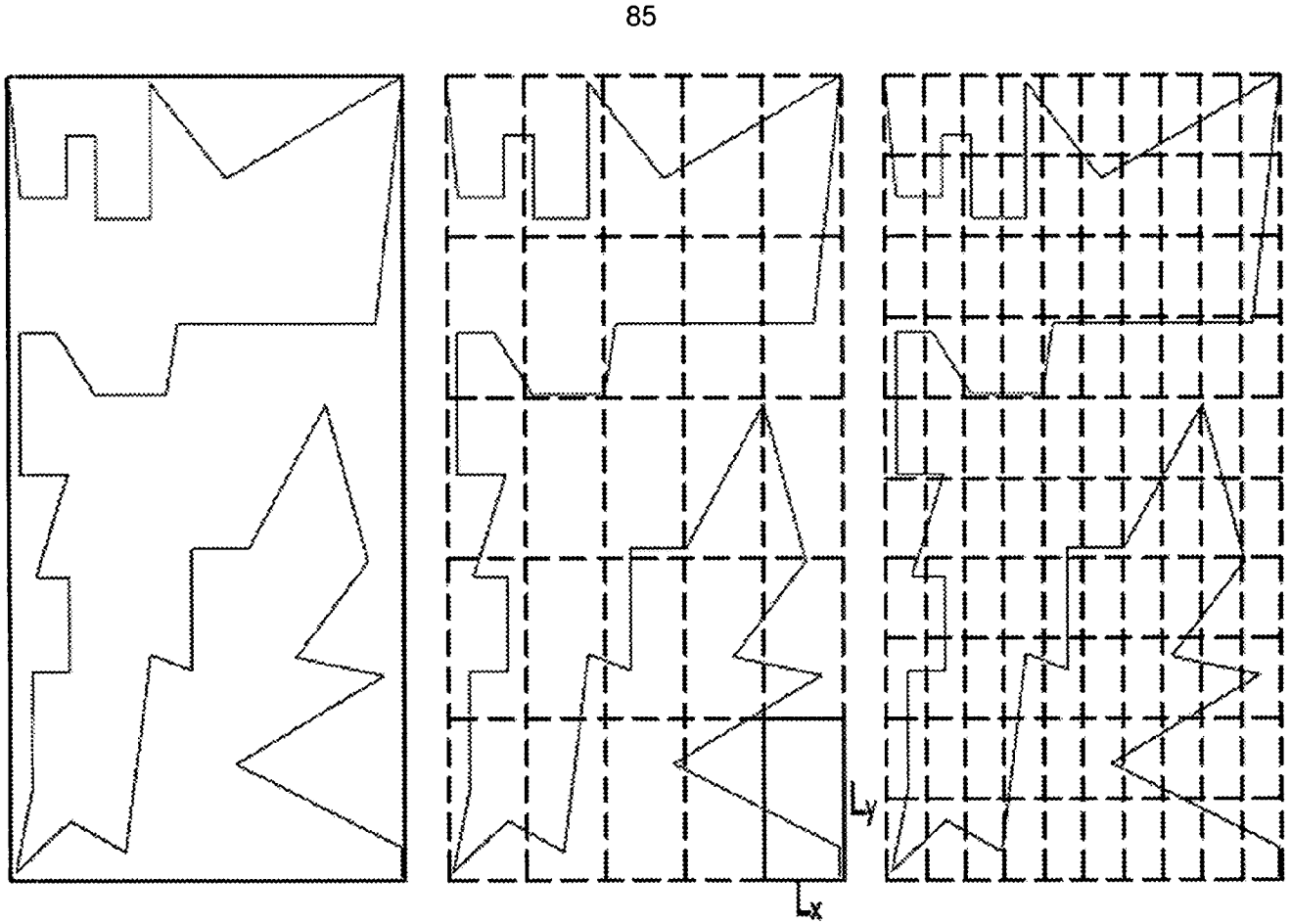

FIG. 14—Example of how to calculate the box counting dimension using a grid of rectangular cells to divide the smallest possible rectangle enclosing the curve.

Figure 15:
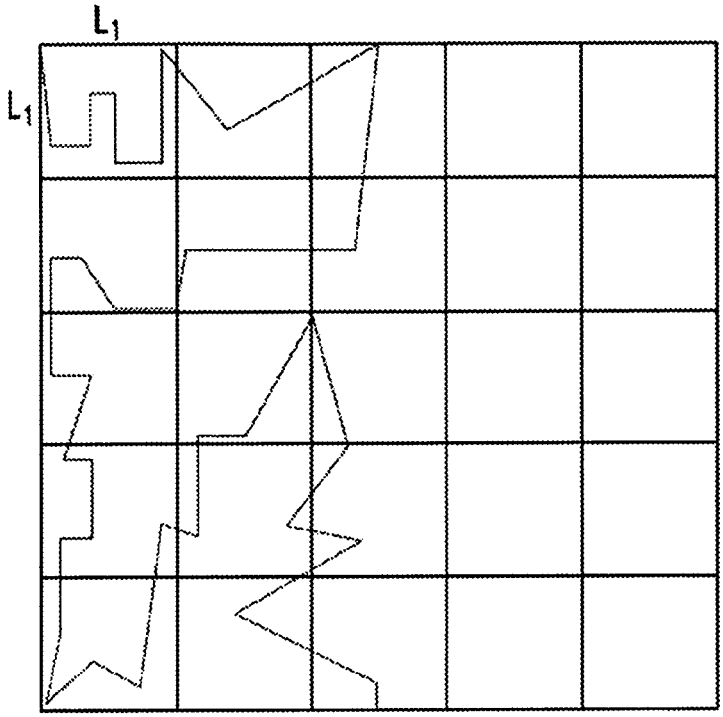
Figure 15:
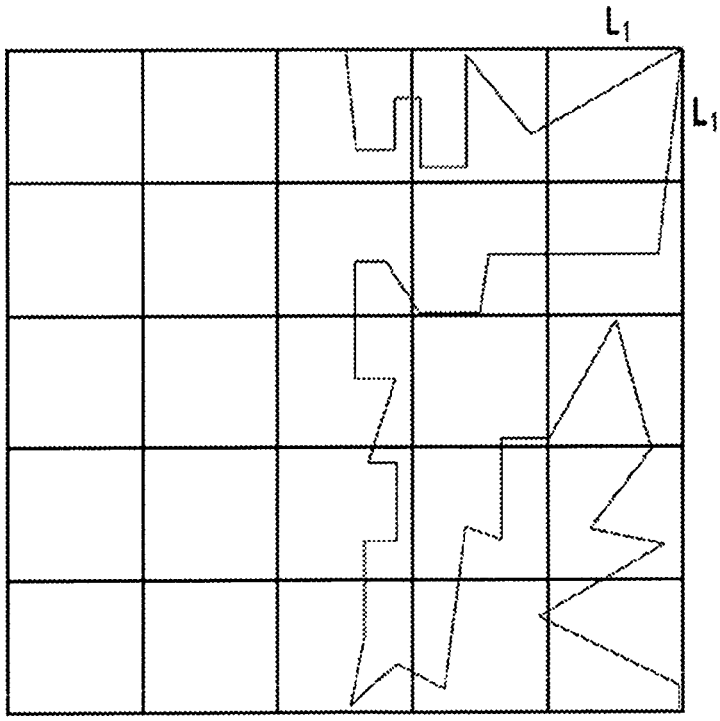

FIG. 15—Example of how to calculate the box counting dimension using a grid of substantially square cells.

FIG. 16—Example of a curve featuring a grid-dimension larger than 1, referred to herein as a grid-dimension curve.

FIG. 17—The curve of FIG. 16 in the 32-cell grid, wherein the curve crosses all 32 cells and therefore N1=32.

FIG. 18—The curve of FIG. 16 in a 128-cell grid, wherein the curve crosses all 128 cells and therefore N2=128.

FIG. 19—The curve of FIG. 16 in a 512-cell grid, wherein the curve crosses at least one point of 509 cells.

DESCRIPTION OF THE PREFERRED EMBODIMENTS

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

FIG. 1 shows an example of a dual-polarized radiating element having overlapping patches, which here are provided in a cross-shaped geometry.

As depicted in FIG. 1*a*, the radiating element 100 comprises a first conducting patch 101 having a substantially rectangular shape, a second conducting patch 102 having also a substantially rectangular shape and a ground plane layer 103. The first conducting patch 101 and the second conducting patch 102 are both placed above the ground plane layer 103. Moreover, the second conducting patch 102 is placed also above the first conducting patch 101.

The radiating element 100 further comprises a first feeding port 104, including a primary channel coupled by direct contact to the first conducting patch 101, and a second feeding port 105, including a primary channel coupled by direct contact to the second conducting patch 102.

Referring now to FIG. 1*b*, the orthogonal projection of the first conducting patch 101 on the ground plane layer 103 is confined within a first patch rectangle 111, having a long edge $L_1$ and a short edge $S_1$. Similarly, the second conducting patch 102 is confined within a second patch rectangle 112, said second patch rectangle 112 having a long edge $L_2$ and a short edge $S_2$. In this example, the first patch rectangle 111 and the second patch rectangle 112 have substantially the same dimensions (i.e., $L_1$ and $L_2$ are approximately equal, and so are $S_1$ and $S_2$). The ratio between the long and the short edge of the first patch rectangle 111, and also that of the second patch rectangle 112, is larger than 4.5. For illustration purposes the lines of the patch rectangles 111, 112 are drawn with a little separation from the border of the patch projections, while the patch rectangle 111, 112 in general touches the patch projection on each of the four sides.

The first and second conducting patches 101,102 are arranged so that the edge $L_1$ of the first patch rectangle 111 is approximately at an angle of 90 degree with respect to the edge $L_2$ of the second patch rectangle 112.

The second conducting patch 102 crosses above the first conducting patch 101, defining a region of overlapping between the first patch rectangle 111 and the second patch rectangle 112, resulting in a cross-shaped geometry. Said region of overlapping is smaller than 25% of the smaller of the first and second patch rectangles 111,112, and occurs around the center portions of the first and second conducting patches 101,102.

A further indication of the cross-shaped geometry of the patch antenna 100 is provided by its degree of filling of the radiating element rectangle. In FIG. 1*b*, the orthogonal projection of the first and second conducting patches 101,102 is confined within a minimum-sized rectangle 113 (the radiating element rectangle). The orthogonal projection of the first and second conducting patches 101,102 on the ground plane layer 103 occupies less than 40% of the area of said rectangle 113, leaving more than 60% of the area of said rectangle 113 free of projection (i.e., not being covered by the conducting patches 101,102 of the radiating element 100).

A cross-sectional view (or elevation view) of the radiating element 100 is presented in FIG. 1*c*, in which it can be observed the arrangement of the first and second conducting patches 101,102 with respect to each other, and with respect to the ground plane layer 103. The height of the radiating element 100, in this example determined by the height of the second conducting patch 102 with respect to the ground plane layer 103, is smaller than a 4% of the free-space operating wavelength of the radiating element 100.

In this example, the radiating element 100 comprises a dielectric substrate 120 placed between the first and second conducting patches 101,102. The first conducting patch 101 lies on the lower side of said dielectric substrate 120, while the second conducting patch lies on the upper side of said dielectric substrate 120 (i.e., the first and second conducting patches 101,102 are on opposite sides of a common dielectric substrate 120).

The first feeding port 104 comprises a ground channel (not depicted in FIG. 1*c*) coupled to the ground plane layer 103 and a primary channel that includes a conducting pin 121 and is coupled by direct contact to the first conducting patch 101. Similarly, the second feeding port 105 also comprises a ground channel and a primary channel that includes a conducting pin 122 and is coupled by direct contact to the second conducting patch 102.

By providing the first conducting patch 101 and the second conducting patch 102 at different heights, it is possible to excite two radiation modes having substantially linear polarizations oriented along two orthogonal directions.

A first polarization is substantially aligned with the long edge of the first patch rectangle 111 ($L_1$), while a second polarization is substantially aligned with the long edge of the second patch rectangle 112 ($L_2$).

A signal fed to the patch antenna 100 through the first feeding port 104 is radiated by the radiating element 100 as a wave having a first polarization substantially aligned with the long edge of the first patch rectangle 111 ($L_1$). In reception mode, a wave impinging the radiating element 100 and having a first polarization substantially aligned with the long edge of the first patch rectangle 111 ($L_1$) is predominantly delivered to the first feeding port 104.

Analogously, a signal fed to the radiating element 100 through the second feeding port 105 is radiated by the radiating element 100 as a wave having a second polarization substantially aligned with the long edge of the second patch rectangle 112 ($L_2$). Similarly, in reception mode, a wave having said second polarization is predominantly delivered to the second feeding port 105.

FIG. 2 shows a typical polarization pattern of the dual-polarized radiating element 100. The polar plot 200 represents in a normalized dB scale the power that is coupled between the radiating element 100 and an ideal linearly-polarized test antenna placed in the far field as the linear polarization of said test antenna is rotated on a plane parallel to the ground plane layer 103.

Curve 201 (depicted as a solid line) and curve 202 (depicted as a dashed line) correspond to the power coupled between the radiating element 100 and said test antenna when the radiating element 100 is driven respectively through its first feeding port 104, or through its second feeding port 105.

Curve 201 has two maxima, at 90° and −90°, and two minima, at 0° and 180°, resulting in an eight-shaped curve oriented substantially along a first direction parallel to the long edge of the first patch rectangle 111 ($L_1$). On the other hand, curve 202 has its maxima, at 0° and 180°, and its minima, at 90° and −90°, resulting in another eight-shaped curve oriented substantially along a second direction parallel to the long edge of the second patch rectangle 112 ($L_2$), and substantially perpendicular to said first direction. Therefore, the radiating element 100 having a cross-shaped geometry is capable of providing two orthogonal polarizations in a given frequency band.

Referring now to FIG. 3, it is shown another example of a dual-polarized radiating element (also being a patch antenna) having a cross-shaped geometry. FIG. 3*a* presents a perspective view of the dual-polarized radiating element, while FIG. 3*b* provides an exploded view showing the different constructive parts of the structure.

As in the previous example, the radiating element 300 comprises a first conducting patch 301, a second conducting patch 302 and a ground plane layer 305. The second conducting patch 302 is placed above the first conducting patch 301, and both the first and second conducting patches 301, 302 are placed above the ground plane layer 305.

The radiating element 300 further comprises parasitic elements in order to enhance its radioelectric performance. In particular, a third conducting patch 303 is placed above the first and second conductive patches 301,302 and substantially aligned with respect to the first conducting patch 301. Due to this orientation the third conducting patch 303 is associated to or corresponding to the first conducting patch 301, which is electrically driven. A fourth conducting patch 304 is placed above the first, second and third conductive patches 301, 302, 303 and substantially aligned with respect to the second conducting patch 302 (and hence associated with it or corresponding to it).

The vertical separation between the first conducting patch 301 and the third conducting patch 303 (or between the second conducting patch 302 and the fourth conducting patch 304) is between a 6% and a 10% of the free-space operating wavelength of the radiating element 300 in order to obtain an advantageous coupling between the electrically driven conducting patches 301,302 and the parasitic conducting patches 303,304.

In this example, the conducting patches 301-304 have all a substantially rectangular shape. Moreover, the first and second conducting patches 301,302 have approximately the same dimensions, and are larger in size than the third and fourth conducting patches 303,304, which also have approximately the same dimensions.

As in the example of FIG. 1, the first conducting patch 301 crosses above the second conducting patch 302 defining a cross-shaped geometry. In fact, the first and second conducting patches can be confined within first and second patch rectangles having each a long-to-short edge ratio above 4.5, and said first and second patch rectangles overlapping in less than 25% of their respective areas.

Moreover, the fourth conducting patch 304 crosses above the third conducting patch defining also a cross-shaped geometry for the parasitic elements.

The degree of filling of the radiating element rectangle is a good indicator of the cross-shaped geometry of said patch antenna. In the case of the radiating element 300, the orthogonal projection of the conducting patches 301-304 on the ground plane layer 305 occupies at most 40% of the area of a minimum-sized rectangle confining said projection (i.e., more than 60% of the area of said minimum-sized rectangle is not covered by the conducting patches 301-304 of the patch antenna 300).

The height of the radiating element 300, in this example determined by the height of the fourth conducting patch 304 with respect to the ground plane layer 305, is smaller than a 14% of the free-space operating wavelength, hence resulting in a solution featuring a low profile.

The first and second conducting patches 301,302 are advantageously arranged on opposite sides of a first dielectric substrate 306. For example, the first and second conducting patches 301,302 can be etched from a thin metal layer deposited on said opposite sides of the first dielectric substrate 306. Similarly, the third and fourth conducting patches 303,304 are advantageously arranged on opposite sides of a second dielectric substrate 307.

The radiating element 300 includes a dielectric post 310 to provide mechanical support to the first and second dielectric substrates 306,307. Said dielectric post 310 is located in the region in which the orthogonal projection of the conducting patches 301-304 overlap, because a hole can be drilled in this region of the conducting patches 301-304 without substantially disturbing their current distributions.

In FIG. 3*b*, a first hole 313 has been created all the way through the first conducting patch 301, the first dielectric substrate 306 and the second conducting patch 302, while a second hole 314 has been created all the way through the third conducting patch 303, the second dielectric substrate 307 and the fourth conducting patch 304.

A first dielectric spacer (see also reference sign 311 in FIG. 5*d*) sets the height of the first dielectric substrate 306 with respect to the ground plane layer 305, while a second dielectric spacer 312 sets the height of the second dielectric substrate 307 with respect to the first dielectric substrate 306.

To hold the structure of the radiating element 300 together, the dielectric post 310 can be slid through the first and second holes 313,314 and the first and second dielectric spacers 311,312, and then attached (for example by means of a screw, which may be dielectric or even metallic) to the ground plane layer 305.

While a substrate 307 of the parasitic elements 303, 304 itself maybe shaped to have a cross configuration a substrate 306 for the electrically driven elements 301, 302 does not have a cross geometry or vice versa. The cross geometry of one substrate allows for little dielectric material close to the radiative components (for reducing losses) while the non-cross geometry such as square or rectangle allows for allocating further items in the empty corners of cross configuration of patches provided on a non-cross shaped substrate.

In this example, the radiating element 300 further comprises a first feeding port 321 and a second feeding port 322. The second feeding port 322 includes a primary channel coupled to the second conducting patch 302 by direct contact.

On the other hand, the first feeding port 321 includes a primary channel coupled to the first conducting patch 301 by capacitive means.

FIG. 4 shows a detailed view of the first dielectric substrate 306 near the region in which the second conducting patch 302 crosses above the first conducting patch 301. The figure also shows the first hole 313 created all the way through the first conducting patch 301, the first dielectric substrate 306 and the second conducting patch 302.

In this view it is possible to observe the capacitive means used to couple the primary channel of the first feeding port 321 to the first conducting patch 301. Said capacitive means comprise a polygonal pad 400 placed substantially in the orthogonal projection of the first conducting patch 301. Moreover, said polygonal pad 400 is located above the first conducting patch 301 and advantageously coplanar to the second conducting patch 302.

The primary channel of the first feeding port 321 takes the form of a conducting pin 401. Said conducting pin 401 is substantially perpendicular to the ground plane layer 305, and extends from below the ground plane layer 305 up to the polygonal pad 400 to which it is connected. The ground plane layer 305 and the first conducting patch 301 comprise each a hole, such as for example hole 402 created in the first conducting patch 301, to allow the conducting pin 401 go through them avoiding electrical contact.

The primary channel of the second feeding port 322 takes also the form of a conducting pin 403, said conducting pin 403 extending from below the ground plane layer 305 up to the second conducting patch 302 to which is connected.

The region of overlap between the polygonal pad 400 and the first conducting patch 301 behaves as a parallel plate capacitor, whose capacitance is determined by the area of said region of overlap, the vertical separation between the polygonal pad 400 and the first conducting patch 301, and the dielectric constant of the first dielectric substrate 306 located between the polygonal pad 400 and the first conducting patch 301. Said capacitance is preferably selected to cancel the parasitic inductive behavior of the conducting pin 401.

In this particular example the polygonal pad 400 has six sides although pads having a different number of sides, or different shapes, could also be used.

A portion of the polygonal pad 400 closer to the second conducting patch 302 is preferably narrower that the portion of said polygonal pad 400 located farther away from the second conducting patch 302. In the example in FIG. 4, the polygonal pad 400 has a minimum width $W_1$ at an edge closest to the second conducting patch 302, located at a distance $d_1$ from said second conducting patch 302. As the polygonal pad 400 extends away from said second conducting patch 302, its width increases gradually to $W_2$ and finally $W_3$ at the edge located at the farthest distance $d_2$ from the second conducting patch 302.

In some embodiments, a polygonal pad with a geometrical shape being narrower in its portion closer to the second conducting patch is advantageous in reducing undesired coupling between the polygonal pad and the second conducting patch.

In some cases, as for instance in the example in FIG. 4, it might be necessary to further reduce said undesired coupling to modify the shape of the second conducting patch 302, so that it recedes in a portion closest to the polygonal pad 400, increasing the minimum separation $d_1$ between the polygonal pad 400 and the second conducting patch 302.

FIG. 5 presents an embodiment of a dual-band dual-polarized antenna assembly according to the present invention that provides two orthogonal polarizations in a first and in a second frequency band. The ratio between the center frequencies of the second frequency band and the first frequency band is approximately 2.4, thus advantageously between 1.8 and 2.5.

Figure 5A:
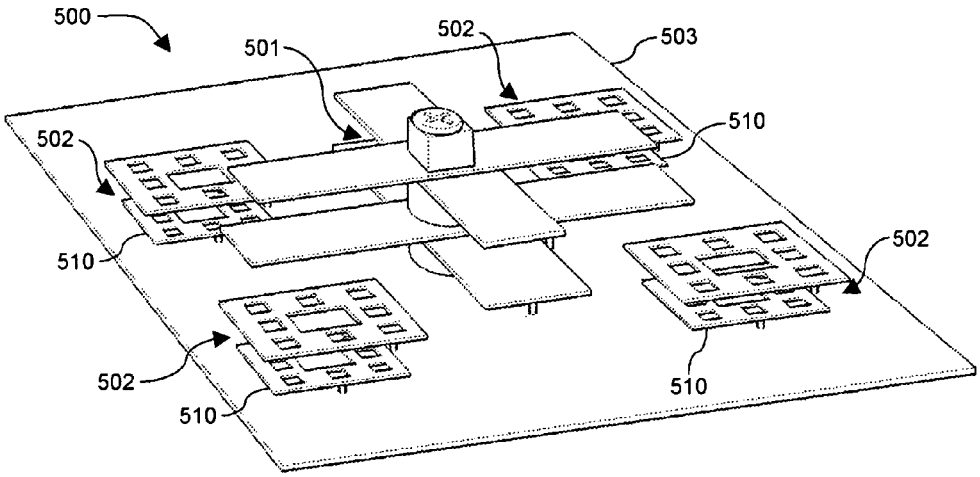

FIG. 5*a* shows a perspective view of the antenna assembly 500, which comprises a first set of antenna assembly elements 501 operating at the first frequency band, and a second set of antenna assembly elements 502 operating at the second frequency band. Both said first and second sets 501, 502 are placed above a common ground plane layer 503. A total of six antenna assembly elements are provided, each including one electrically driven patch.

At least one of the first and second sets of antenna assembly elements 501, 502 comprises patch antenna elements. More specifically, the first set of antenna assembly elements 501 comprises a single dual-polarized radiating element having a cross-shaped geometry as the example in FIG. 3. In addition to that, the second set of antenna assembly elements 502 comprises four patch antenna elements. The use of patch antenna elements in the first and second sets of antenna assembly elements 501, 502 allows for an antenna assembly 500 featuring a low profile.

Figure 5B:
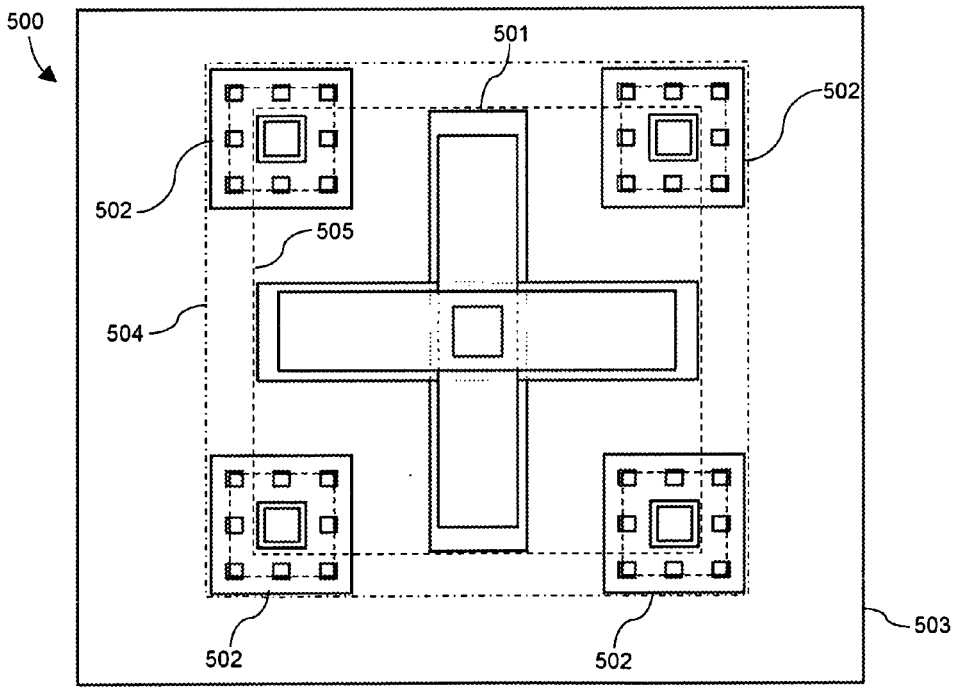

FIG. 5*b* presents a top plan view of the antenna assembly 500, in which it can be observed that the orthogonal projection of the first set of antenna assembly elements 501 on the ground plane layer 503 does not overlap the orthogonal projection of the second set of antenna assembly elements 502, avoiding undesired screening effects of the first set of antenna assembly elements 501 over the second set of antenna assembly elements 502, and possibly decreasing the coupling between antenna assembly elements. Further none of the different antenna assembly elements of the second set 502 overlap with each other (apart from parasitic elements discussed below).

Rectangle 505 is a minimum-size rectangle enclosing the orthogonal projection of the first set of antenna assembly elements 501, while rectangle 504 is a minimum-size rectangle enclosing the orthogonal projection of the second set of antenna assembly elements 502.

The arrangement of the antenna assembly elements in the antenna assembly 500 is such that rectangle 505 is completely inside rectangle 504, which makes it possible for the antenna assembly 500 feature reduced transversal dimensions. In particular the transversal dimensions of the antenna assembly are advantageously smaller than 0.55 times the free-space operating wavelength of the antenna assembly 500.

The antenna assembly elements of second set 502 are dual-polarized patch antenna elements capable of providing two orthogonal polarizations. Each of said antenna assembly elements comprises one electrically driven patch 510 and one parasitic patch 511. The electrically driven patches 510 and the parasitic patches 511 feature a complex geometry inspired in the geometry of the Sierpinski carpet, which may be advantageous to miniaturize the size of the patch antenna elements of the second set of antenna assembly elements 502 and/or allow said patch antenna elements to operate in one or more additional frequency bands.

While in FIG. 5*a* the two feeding ports of each patch 510 is provided on the same two sides (lower and right in FIG. 5*a*), in general it is also possible to have two of the four patches, which are on diagonally opposite locations with their feeding ports on the respective opposite sides. E.g. the patch 510 in the lower left corner and the one in the upper right corner could have their feeding terminals on the upper and left side. The feeding scheme in this case should include the possibility of a 180° phase shift for those patches. This configuration allows for an improvement of the isolation between the feeding of different patches since the currents induced in one patch from neighboring patches are not added constructively.

Figure 5C:
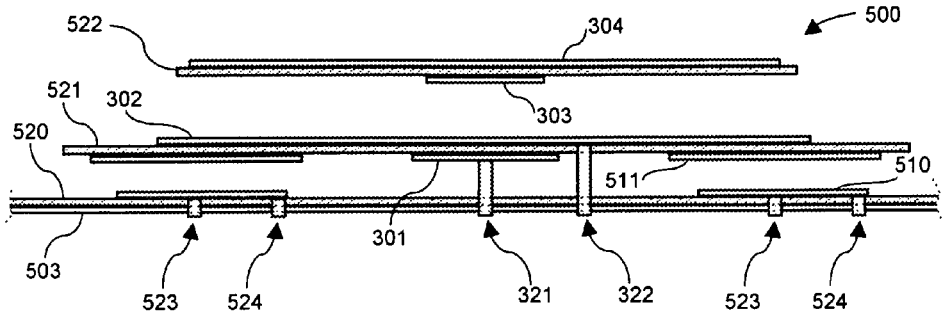
Figure 5D:
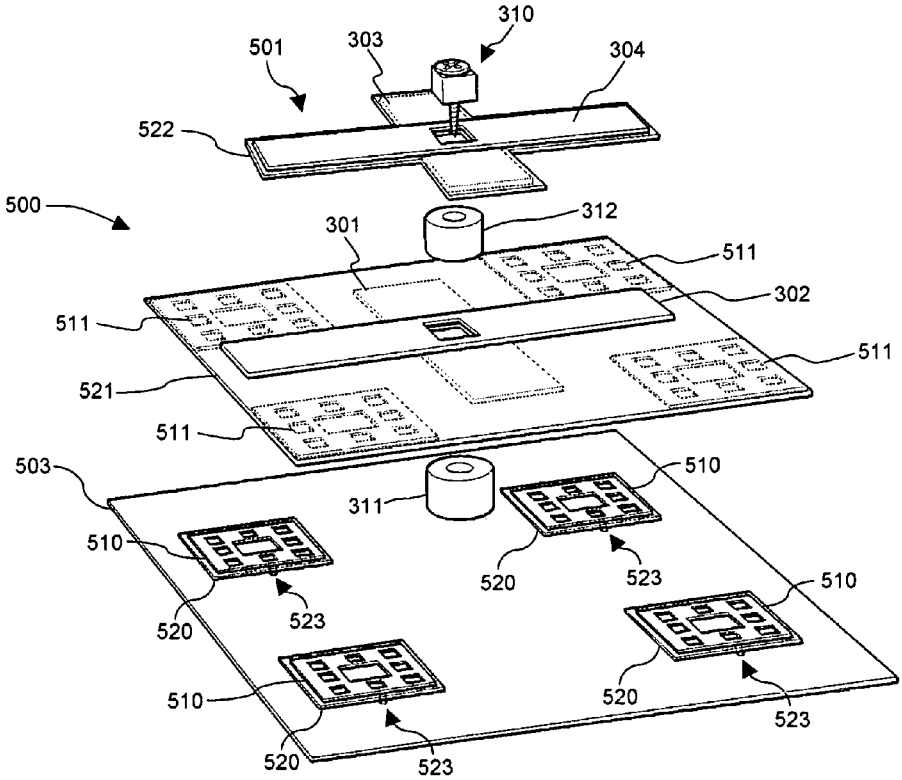

FIG. 5*c* shows a cross-sectional view of the antenna structure 500, while FIG. 5*d* presents an exploded view of the structure showing its constructive parts.

As already described when referring to FIG. 3, the single dual-polarized radiating element having a cross-shaped geometry of the first set of antenna assembly elements 501 comprises four conducting patches 301-304, a first feeding port 321 with a primary channel coupled to the first conducting patch 301, and a second feeding port 322 with a primary channel coupled to the second conducting patch 302.

Each of the electrically driven patch antenna elements of the second set of antenna assembly elements 502 may also comprise two feeding ports 523,524 to excite two-orthogonal polarizations in the second frequency band.

In a preferred embodiment the four electrically driven patches 510 of the patch antenna elements of the second set of antenna assembly elements 502 are substantially coplanar and arranged on an upper side of a first dielectric substrate 520. The ground plane layer 503 may be advantageously arranged as a metallized layer on a lower side of said first dielectric substrate 520.

The four parasitic patches 511 of the second set of antenna assembly elements 502 are preferably coplanar to the first conducting patch 301 of the cross-shaped radiating element of the first set of antenna assembly elements 501, and said parasitic patches 511 and said first conducting patch advantageously arranged on a lower side of a second dielectric substrate 521. The second conducting patch 302 of the cross-shaped radiating element of the first set of antenna assembly elements 501 may be arranged on the upper side of said second dielectric substrate 521.

Finally, the third and fourth conducting patches (parasitic patches) 303, 304 (of the cross-shaped radiating element) of the first set of antenna assembly elements 501 are advantageously arranged on opposite sides of a third dielectric substrate 522.

FIG. 6 shows another example of a dual-band dual-polarized antenna assembly according to the present invention, similar to the embodiment described in FIG. 5 but in which the second set of antenna assembly elements comprises patch antenna elements featuring a square shape. Although the antenna assembly elements 602 are patch antenna elements featuring a square shape in the antenna assembly of FIG. 6, other shapes (such as for instance circular shapes) are also possible.

An antenna assembly 600 comprises a first set of antenna assembly elements 501, a second set of antenna assembly elements 602, and a ground plane layer 503 common to the first and second sets of antenna assembly elements. A total of six antenna assembly elements are provided, each including one electrically driven patch.

As in the previous example, each one of the antenna assembly elements of the second set 602 comprises one electrically driven patch and one parasitic patch, said parasitic patch placed above, and substantially centered with respect to, its corresponding electrically driven patch.

Figure 6A:
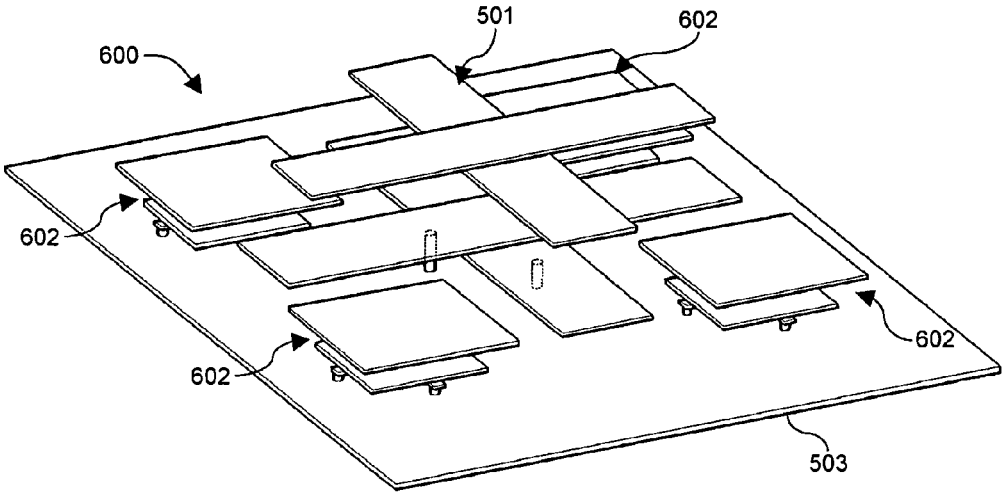
Figure 6B:
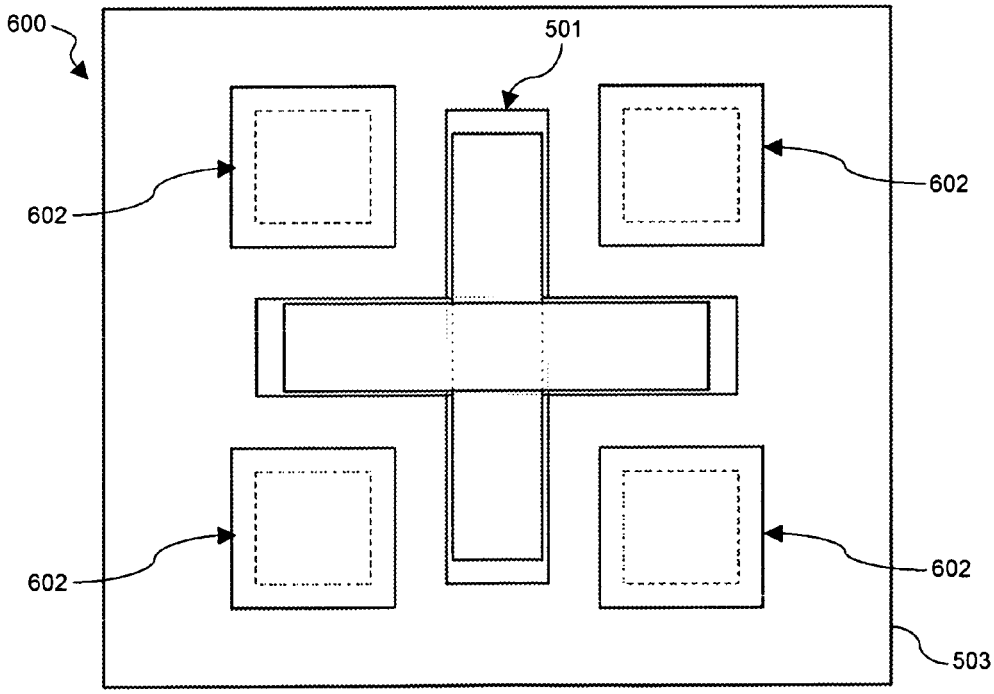

FIG. 6*a* is a perspective view of the antenna assembly 600, while FIG. 6*b* represents a top plan view. The use of a single dual-polarized radiating element having a cross-shaped geometry as the first set of antenna assembly elements 501 allows the placement of four square patch antenna elements in the second set of antenna assembly elements 602 in such an advantageous way that there is no overlapping between the orthogonal projections of the first and second sets of antenna assembly elements 501, 602, avoiding screening effects and hence enhancing the radioelectric performance of the antenna assembly 600.

Referring now to FIG. 7, it is shown a further example of a dual-band dual-polarized antenna assembly according to the present invention. The antenna assembly 700 comprises a first set of antenna assembly elements 701 including four dipole antenna elements 701*a-d* that operate in a first frequency band, and a second set of antenna assembly elements 602 including four patch antenna elements operating in a second frequency band. Said second set of antenna assembly elements 602 is similar to the one already described in FIG. 6. The antenna assembly 700 also comprises a ground plane layer 503 common to the first and second sets of antenna assembly elements 701, 602.

Within the first set of antenna assembly elements 701, dipole antenna elements 701*a* and 701*c* provide a first polarization, while dipole antenna elements 701*b* and 701*d* provide a second polarization.

In this example, the radiating arms of the dipole antenna elements 701*a-d* have a rectangular shape and are placed substantially parallel to the ground plane layer 503 at a height between 20% and 25% of the wavelength corresponding to the center frequency of the first frequency band.

Figure 7B:
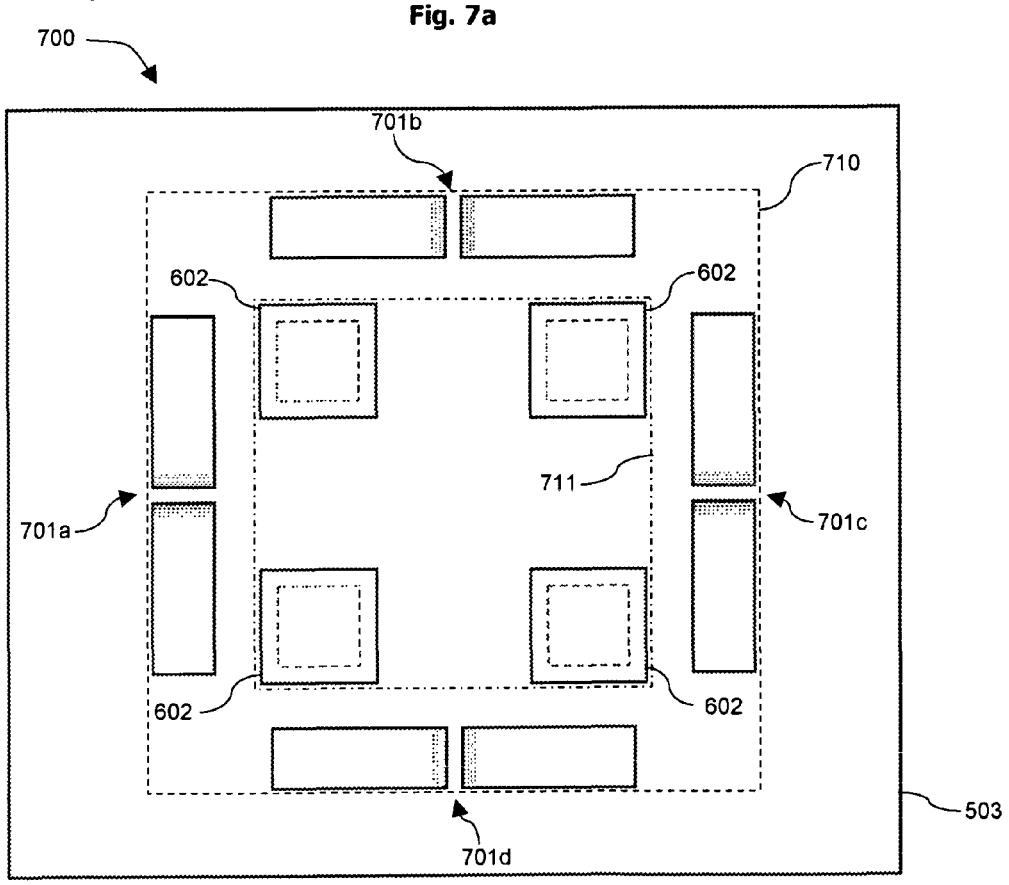

FIG. 7*b* shows a top plan view of antenna assembly 700. As it can be seen, the orthogonal projection of the antenna assembly elements of the first set 701*a-d* on the ground plane layer 503 does not overlap the orthogonal projection of the antenna assembly elements of the second set 602, avoiding screening effects.

The rectangle 710 is the minimum-size rectangle enclosing the orthogonal projection of the antenna assembly elements of the first set 701, while the rectangle 711 is the minimum-size rectangle enclosing only the orthogonal projection of the antenna assembly elements of the second set 602.

Differently from the examples presented in FIGS. 5 and 6, the rectangle 710 enclosing the orthogonal projection of the first set of antenna assembly elements 701, also encloses the orthogonal projection of the second set of antenna assembly elements 602 (i.e., rectangle 711 is completely inside rectangle 710). Therefore, the transversal dimensions of the antenna assembly 700 are determined by the dimensions of rectangle 710. Said rectangle 710 has a longest dimension smaller than 0.8 times the free space operating wavelength corresponding to the lowest frequency band of operation of the entire antenna assembly 700.

The orthogonal projection of each of the dipole antenna elements 701*a-d* of the first set of antenna assembly elements is located substantially close to, and aligned with, each one of the edges of the rectangle 710.

Moreover, dipole antenna elements providing a same polarization, such as dipole antenna elements 701*a* and 701*c*, or 701*b* and 701*d*, have their orthogonal projections substantially close to, and aligned with, opposite edges of the rectangle 710.

Each dipole antenna element 701*a-d* comprises a first connection portion 721 that connects a first radiating arm 720 to the primary channel of a feeding port, and a second connection portion 721' that connects a second radiating arm 720' to the ground plane layer 503. Said first and second connection portions 721,721' extend from the first and second radiating arms 720,720' to the ground plane layer 503 substantially perpendicular to said ground plane layer 503. The first and second connection portions 721,721', in addition to providing mechanical support to the first and second radiating arms 720,720', advantageously implement a balun transformer.

In some examples, one or even both radiating arms and their corresponding connection portions of the dipole antenna elements 701*a-d* can be fabricated as a single piece made by means of a process involving the steps of metal casting.

FIG. 8 represents another example of a dual-band dual-polarized antenna assembly according to the present invention comprising dipole antenna elements operating in a first frequency band and patch antenna elements operating in the second frequency band.

Figure 8A:
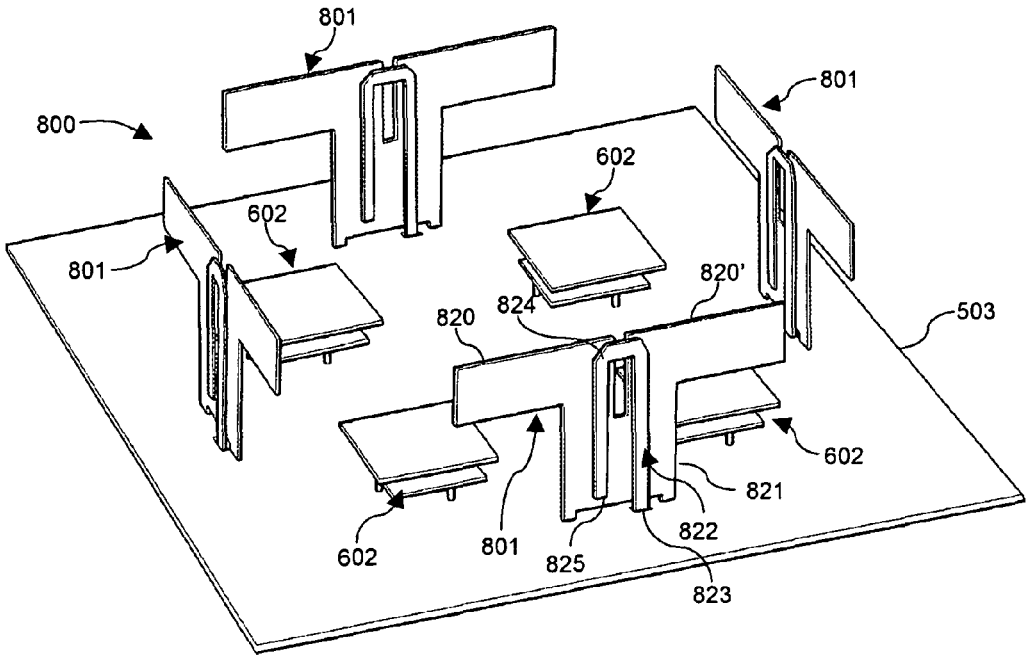
Figure 8B:
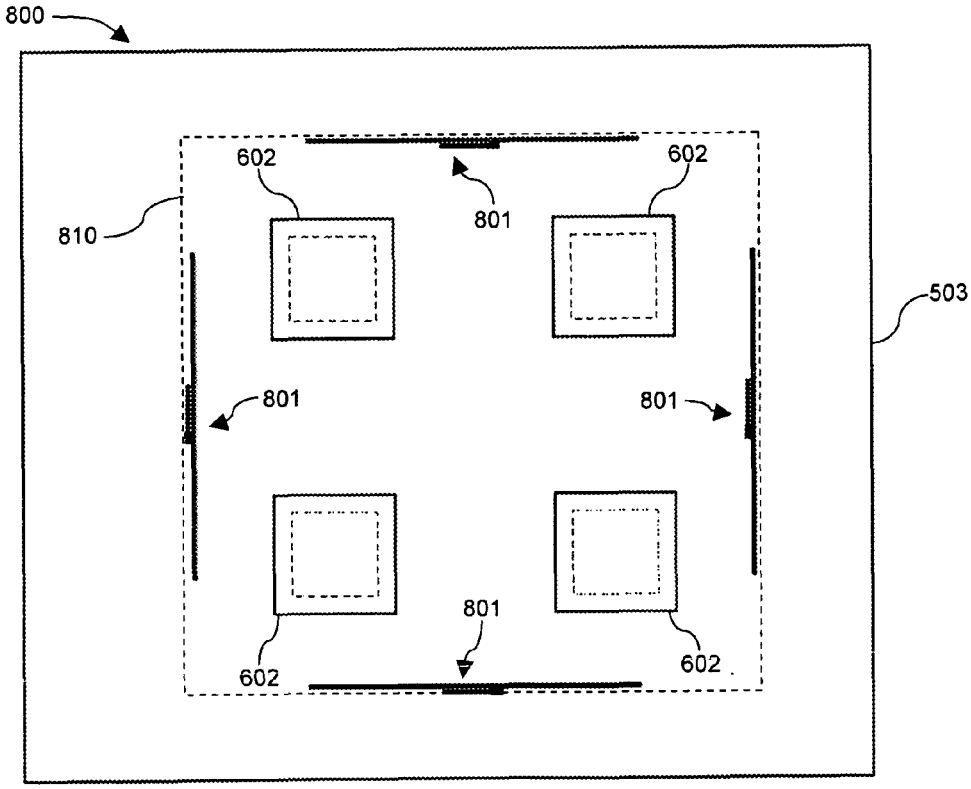

In the perspective view of FIG. 8*a*, it can be observed that the second set of antenna assembly elements 602 is the same as the one in FIGS. 6 and 7 and comprises patch antenna elements. The first set of antenna assembly elements 801 comprises dipole antenna elements, as in the example of FIG. 7, said dipole antenna elements including radiating arms having also a rectangular shape. However, differently from the embodiment in FIG. 7, the radiating arms of the dipole antenna elements of the first set 801 are placed substantially perpendicular to the ground plane layer 503.

Placing the radiating arms of said dipole antenna elements perpendicularly to the ground plane layer 503 is advantageous in reducing the transversal dimensions of the antenna assembly 800. This can be observed in FIG. 8*b*, which shows a top plan view of the antenna assembly 800. The orthogonal projection of the first and second sets of antenna assembly elements 801, 602 on the ground plane layer 503 is enclosed in a minimum-size rectangle 810. Said rectangle 810 has a longest dimension smaller than 0.75 times the free space operating wavelength corresponding to the lowest frequency band of operation of the antenna assembly 800, and therefore the transversal dimensions of the antenna assembly 800 are smaller than those of the antenna assembly 700.

Each dipole antenna element of the first set of antenna assembly elements 801 comprises a connection portion 821 connected to a first radiating arm 820 and to a second radiating arm 820'. Said connection portion 821 is also connected to the ground plane layer 503, and extends from said ground plane layer 503, substantially perpendicular to it, to the first and second radiating arms 820,820'.

Each dipole antenna element of the first set of antenna assembly elements 801 also comprises a U-shaped conducting track 822, said conducting track 822 forms together with the connection portion 821 a transmission line. The conducting track 822 has a first end 823 connected to the primary channel of a feeding port, and a second end 825 open-circuited.

The conducting track 822 further comprises a point 824, located at a distance from the second end 823 of approximately a quarter of a wavelength corresponding to the center frequency of the first frequency band. At said point 824, the impedance seen by the transmission line formed by the conducting track 822 and the connection portion 821 is very small, allowing efficient coupling of the feeding signal from said transmission line to the first and second radiating arms 820, 820'.

The connection portion 821, in addition to providing mechanical support to the first and second radiating arms 820,820', advantageously implements a balun transformer.

In some examples, the radiating arms 820, 820' and the connection portion 821 can be fabricated on a first conducting layer on a first side of a dielectric substrate arranged perpendicularly to the ground plane layer 503, while the U-shaped conducting track 822 can be fabricated on a second conducting layer on a second side of said dielectric substrate, said second side being opposite to said first side.

Figure 9A:
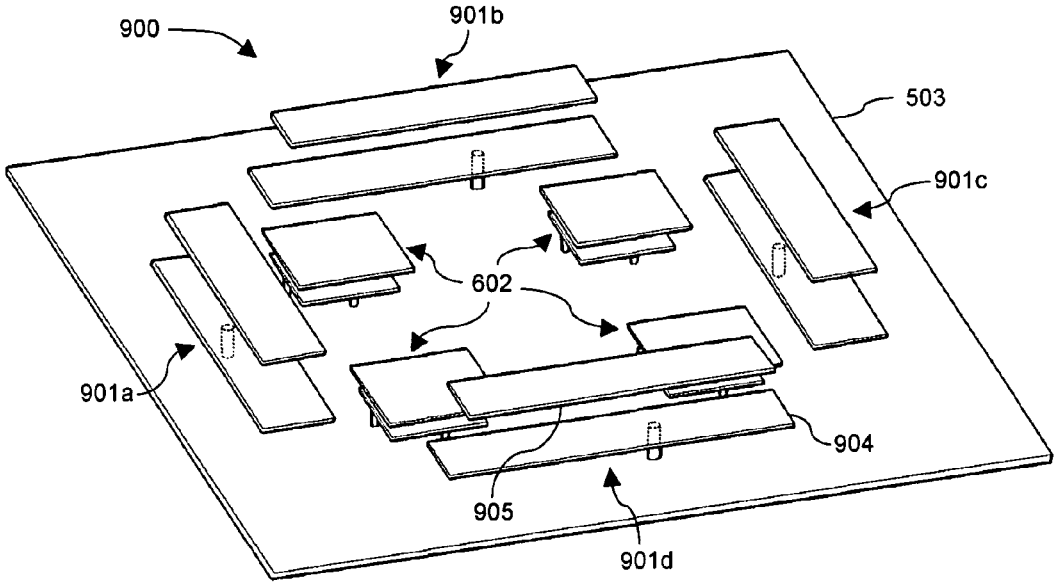

Referring now to FIG. 9, it is depicted an antenna assembly that presents a variation with respect to the embodiments in FIGS. 7 and 8. The antenna assembly 900, shown in perspective view in FIG. 9*a*, comprises patch antenna elements 901*a-d* in its first set of antenna assembly elements instead of dipole antenna elements, as it were the case in the two previous antenna assemblies 700, 800. As far as the antenna assembly elements operating in the second frequency band are concerned, the second set of antenna assembly elements 602 is the same as the one in FIGS. 7 and 8 and comprises dual-polarized patch antenna elements.

The antenna assembly elements 901*a-d* comprise each an electrically driven patch 904 and a parasitic patch 905, each of the parasitic patches 905 being placed above its corresponding electrically driven patch 904, and substantially aligned to it. Patch antenna elements 901*a* and 901*c* provide a first polarization, while patch antenna elements 901*b* and 901*d* provide a second polarization.

Figure 9B:
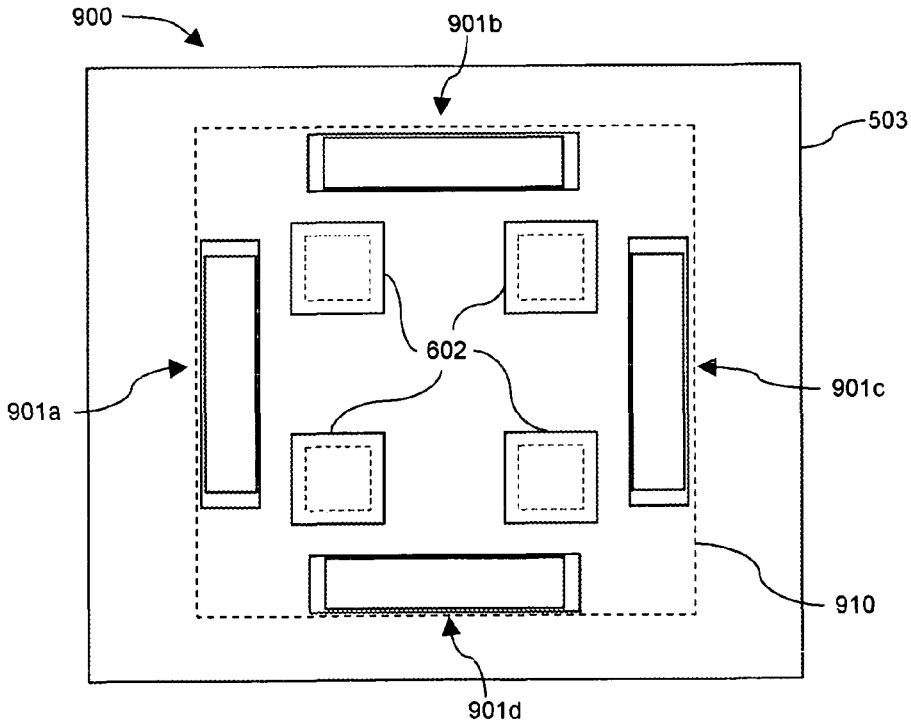

FIG. 9*b* represents the top plan view of the antenna assembly 900, in which it can be observed that the orthogonal projection of the patch antenna elements 901*a-d* of the first set does not overlap the orthogonal projection of the radiating elements of the second set 602.

The rectangle 910, the minimum-size rectangle enclosing the orthogonal projection of the first set of antenna assembly elements 901*a-d*, also encloses the orthogonal projection of the second set of antenna assembly elements 602. Said rectangle 710 has a longest dimension smaller than 0.8 times the free space operating wavelength corresponding to the lowest frequency band of operation of the antenna assembly 900.

Moreover, the orthogonal projection of each of the patch antenna elements 901*a-d* of the first set of antenna assembly elements is located substantially close to, and aligned with, each one of the edges of the rectangle 910.

Compared to the examples shown in FIGS. 7 and 8, the antenna assembly 900 features much lower profile thanks to the use of patch antenna elements in both the first and second sets of antenna assembly elements.

In particular, the height of the antenna assembly 900 is determined by the distance from the parasitic patch 905 of the patch antenna elements 901*a-d* to the ground plane layer 503. Said distance is advantageously smaller than 15% of the free-space operating wavelength corresponding to the lowest frequency band of operation of the antenna assembly 900, which is substantially smaller than the height of the antenna assembly using dipole antenna elements of FIGS. 7 and 8.

A further benefit from the use of patch antenna elements in the first and second sets of antenna assembly elements is that the resulting structure is mechanically simple. The electrically driven patches 904 of the antenna assembly elements 901*a-d* and the parasitic patches of the antenna assembly elements of the second set 602 may be implemented on a same side, or on opposite sides, of a dielectric substrate.

In FIG. 10 it is shown a top plan view of an example dual-band dual-polarized antenna array according to the present invention. The antenna array 1000 comprises nine dual-band dual-polarized antenna assemblies in a 3-by-3 arrangement. The nine antenna assemblies share a common ground plane layer. In particular, said antenna assemblies are as the antenna assembly 500 shown in FIG. 5.

The antenna assembly in the upper right corner has been partially removed (for illustration purposes) to better observe the arrangement of the four electrically-driven patches 510 corresponding to the antenna assembly elements of the second set 502.

The assemblies 500 are arranged such that the separation between two neighboring antenna assembly elements of the second band which are given by two neighboring antenna assemblies 500 is approximately or exactly the same as the separation d between two neighboring antenna assembly elements of the second band which are given by one and the same antenna assembly 500. In other words, although the antenna assembly elements of the second set stem from different antenna assemblies they nevertheless form an equally distanced 6×6 array.

The horizontal and vertical spacing between adjacent antenna assemblies 500(D) is approximately equal to twice the horizontal and vertical spacing between adjacent electrically driven patches 510(*d*).

A feeding and distribution network coupled to the electrically driven patches 510 of the antenna assembly elements of the second set 502 is advantageously arranged on the same layer as said electrically-driven patches 510.

The electrically driven patches 510 of the different antenna assemblies are provided on a common dielectric substrate, while the corresponding parasitic patches are provided on dielectric substrates individual for each antenna assembly 500.

Figure 11A:
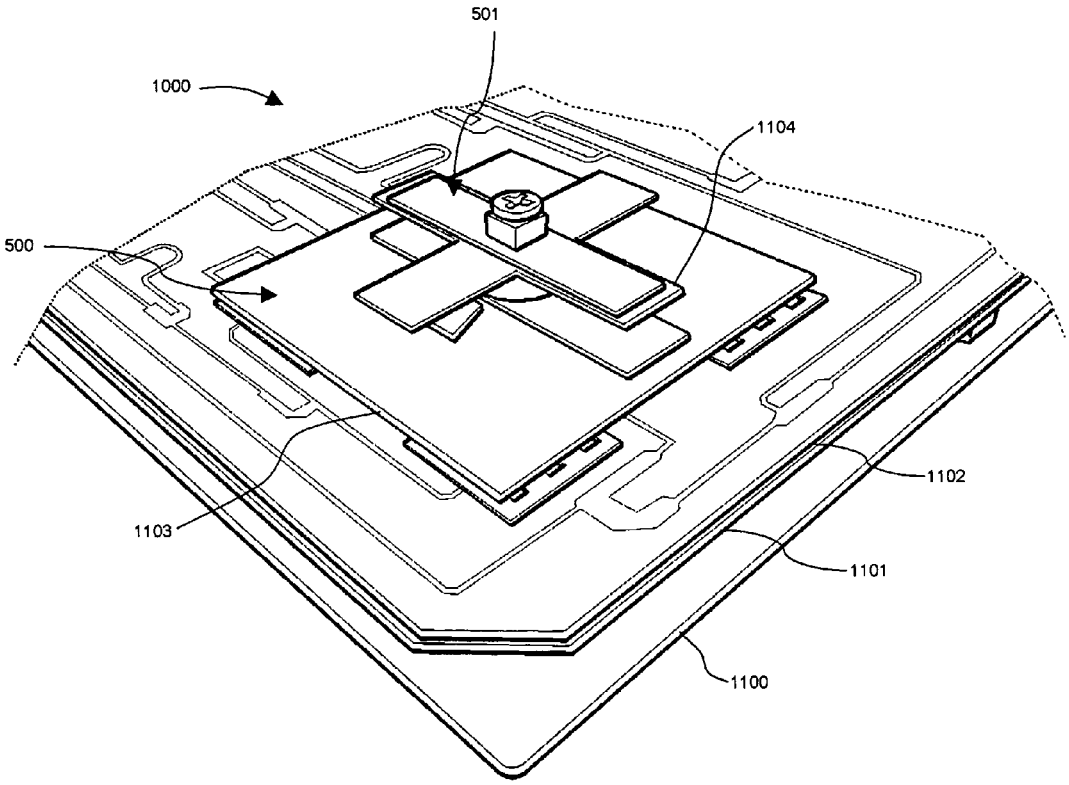
Figure 11B:
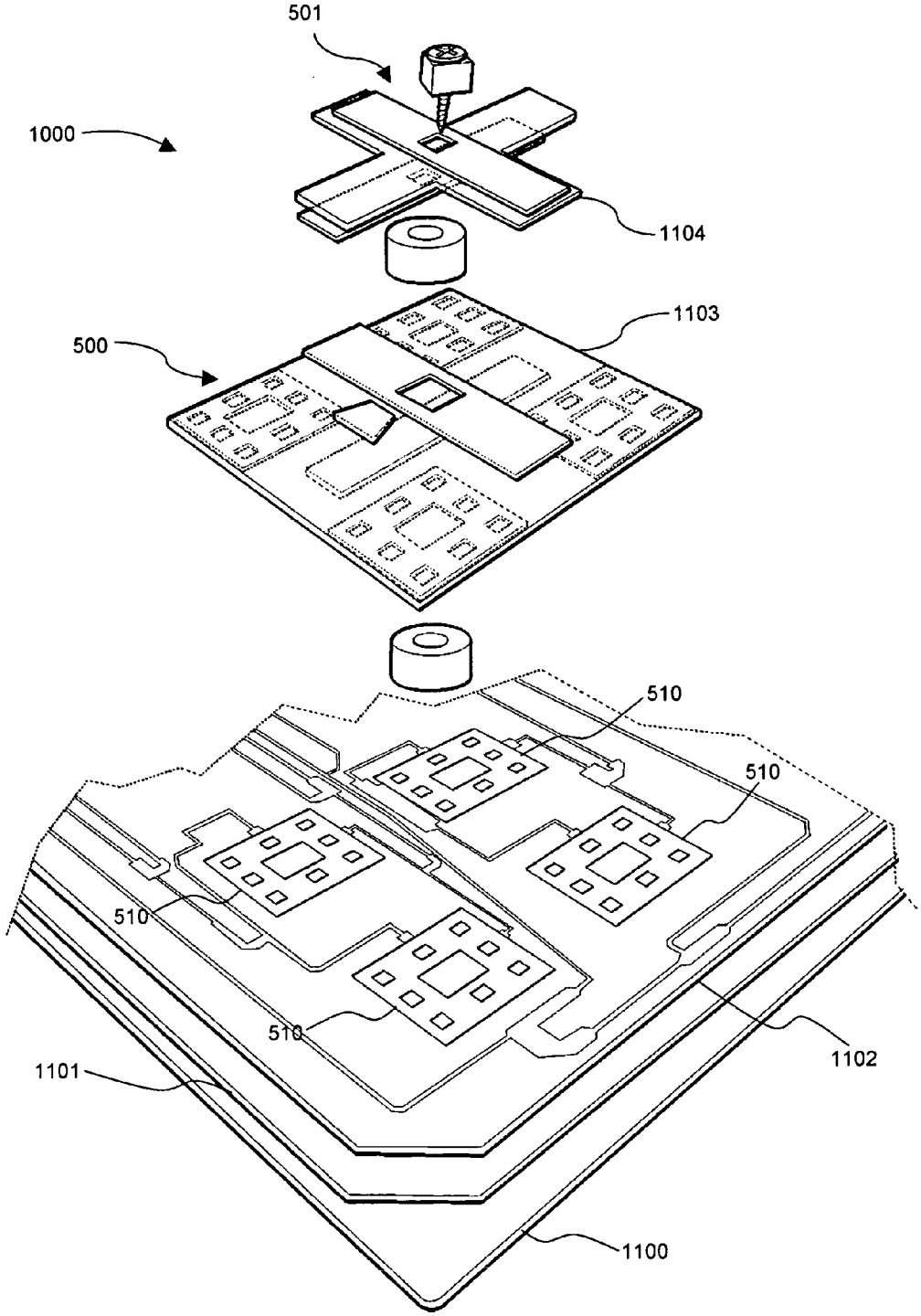

FIG. 11 presents a partial perspective view of the dual-band dual-polarized antenna array 1000 focusing on the antenna assembly 500 closer to the bottom right corner of the antenna array 1000. More specifically, FIG. 11*a* corresponds to an assembled view; while FIG. 11*b* corresponds to the exploded view of the structure showing the constructive layers of the antenna array 1000.

The antenna array 1000 comprises a first dielectric substrate 1101. The lower side of said dielectric substrate 1101 includes the feeding and distribution network coupled to the nine dual-polarized radiating element having a cross-shaped geometry 501 of the radiating antenna assemblies 500. The upper side of said dielectric substrate 1101 includes the ground plane layer common to the plurality of antenna assemblies 500 of the antenna array 1000.

A second dielectric substrate 1102 includes the electrically driven patches 510 of the antenna assembly elements of the second set of the antenna assemblies 500 together with a feeding and distribution network coupled to said electrically driven patches 510.

Said second dielectric substrate 1102 is arranged above the first dielectric substrate 1101 in such a way that an air gap is created between said first and second dielectric substrates 1101,1102. Said air gap may be advantageous to decrease the losses in the feeding and distribution network and to reduce the coupling between tracks of said feeding and distribution network.

A third dielectric substrate 1103, located above the second dielectric substrate 1102, comprises on its lower side the parasitic patches 511 of the second set of antenna assembly elements of an antenna assembly 500, together with the first conducting patch of the radiating element having a cross-shaped geometry 501. Said third dielectric substrate 1103 comprises on its upper side the second conducting patch of said radiating element 501. This third substrate 1103 is individual of each assembly, while the first and second substrates 1101, 1102 are common to different assemblies.

Finally a fourth dielectric substrate 1104, located above the third dielectric substrate 1103, comprises the third conducting patch of the radiating element having a cross-shaped geometry 501 in the lower side of said fourth dielectric substrate 1104, and the fourth conducting patch of said radiating element 501 in the upper side of said fourth dielectric substrate 1104. The fourth substrate is also an individual substrate of each assembly. The third 1103 and/or forth substrate 1104 may also be common substrates of different or all assemblies.

The antenna array 1000 also includes a metal plate 1100 that provides mechanical stability to the array 1000, and allows the attachment of its clamping mechanism.

A radome for enclosing the array is not shown. It will be provided such that it encloses the different radiating components together with the metal plate 1100.

The invention claimed is:

1. A dual-polarized radiating element comprising:
a first patch radiating in a first polarization;
a second patch radiating in a second polarization;
wherein the second polarization is substantially orthogonal to the first polarization;
at least two feeding ports;
wherein each of the at least two feeding ports is coupled to at least one of the first patch and the second patch;
wherein a largest extension of each patch is provided at an angle between 90° and 75°;
wherein the first patch and the second patch are arranged such that two largest extensions cross each other not further away from one middle point than 15% of a length of the largest extension; and
wherein the first patch and the second patch overlap.

2. The element of claim 1, wherein the first patch and the second patch together form a cross.

3. The element of claim 1, wherein:
a coupling patch is placed above the first patch and is substantially coplanar to the second patch; and
the coupling patch provides capacitive coupling between a primary channel of a feeding port and the first patch.

4. The element of claim 1, wherein:
long edges of two patch rectangles of the first patch and the second patch is provided perpendicular; and
a patch rectangle is given by a smallest size rectangle which entirely encloses a corresponding patch.

5. The element of claim 1, wherein:
a short edge of each patch rectangle is less than 50% of a size of a long edge and more than 2% thereof; and
a patch rectangle is given by a smallest size rectangle which entirely encloses a corresponding patch.

6. The element of claim 1, wherein:
a space within each patch rectangle is filled with a conductive area by at least 70%; and
a patch rectangle is given by a smallest size rectangle which entirely encloses a corresponding patch.

7. The element of claim 1, wherein:
a ratio between a length of a shorter edge and a longer edge of a radiating element rectangle is more than 80%; and
the radiating element rectangle is a smallest sized rectangle which completely encloses a projection of at least two patches to a plane parallel to at least one of the patches or a ground plane.

8. The element of claim 1, wherein:
a radiating element rectangle is filled more than 10% but less than 50% by a projection of the first patch and the second patch onto a plane of the radiating element rectangle; and the radiating element rectangle is a smallest sized rectangle which completely encloses a projection of at least two patches to a plane parallel to at least one of the patches or a ground plane.

9. The element of claim 1, wherein an area of overlap of the first and second patch is less than 35% of an area covered by a smaller of the first patch and the second patch.

10. The element of claim 1, wherein:
an overlap area of the first patch and the second patch comprises a size of at least 5% of a smaller of two patch rectangles; and
a patch rectangle is given by a smallest size rectangle which entirely encloses a corresponding patch.

11. The element of claim 1, wherein the first patch and the second patch are on two opposite sides of a dielectric substrate.

12. The element of claim 1, wherein the first patch and the second patch are provided with parasitic elements.

13. The element of claim 12, wherein:
the parasitic elements are provided such that they overlap at least partially with a corresponding patch and are separated in a vertical direction;
the vertical direction is a direction extending perpendicular from a ground plane; and
separation between the patch and the corresponding parasitic element is more than a separation between the patch and a ground plane but not more than 5.0 times the separation.

14. The element of claim 12, wherein:
two parasitic elements overlap each other; and
wherein the two parasitic elements are provided giving a cross shape.

15. A dual-band dual-polarized antenna assembly comprising:
at least one patch antenna element operating in a second frequency band; and
wherein a center frequency of the second frequency band is at least 1.5 times a center frequency of a first frequency band but less than 2.5 times the center frequency of the first frequency band.

16. The assembly according to claim 15, wherein the at least one patch antenna element comprises:
a first patch radiating in a first polarization;
a second patch radiating in a second polarization;
wherein the second polarization is substantially orthogonal to the first polarization;
at least two feeding ports;
wherein each of the at least two feeding ports is coupled to at least one of the first patch and the second patch;

wherein a largest extension of each patch is provided at an angle between 90° and 75°;

wherein the first patch and the second patch are arranged such that two largest extensions cross each other not further away from one middle point than 15% of a length of the largest extension; and wherein the first patch and the second patch overlap.

17. The assembly according to claim 15, wherein:

a set of antenna assembly elements given for providing radiation in the first frequency band comprises dipole antenna elements; and wherein at least two dipole elements are provided which are in parallel to a ground plane and separated from the ground plane by more than 10% of a free space operating wavelength but less than 40% of the free space operating wavelength.

18. The assembly according to claim 15, wherein a projection of antenna assembly elements of the first frequency band is arranged close to and aligned with an enclosing rectangle or square, wherein the antenna assembly elements of the antenna assembly are orthogonally projected onto a common ground plane and an enclosing rectangle or square is one which completely encloses the projections of a different antenna assembly elements.

19. The assembly according to claim 15, wherein antenna assembly elements corresponding to the first frequency band and antenna assembly elements corresponding to the second frequency band have orthogonal projections onto a ground plane which have an overlap of less than 50% of an area of an orthogonal projection of the antenna assembly elements of the first frequency band.

20. The assembly according to claim 15, wherein orthogonal projections onto a ground plane of antenna assembly elements of the first frequency band are enclosed within a first antenna assembly element rectangle and an orthogonal projections of the antenna assembly elements of the second frequency band is enclosed in a second antenna assembly element rectangle, and wherein the first antenna assembly element rectangle is completely enclosed within a second antenna assembly element rectangle.

21. The assembly according to claim 15, wherein one antenna assembly element is provided for providing both polarizations of the second frequency band and wherein two different polarizations can be achieved by different feeding points of the antenna assembly element.

22. The assembly according to claim 15, wherein at least some of the antenna assembly elements of the first and second frequency bands comprise parasitic elements.

23. The assembly according to claim 22, wherein the parasitic elements of the second frequency band are placed coplanar to an antenna assembly element of the first frequency band and wherein the antenna assembly element is an electrically driven element.

24. The assembly according to claim 22, wherein:

a set of antenna assembly elements of the second frequency band comprises the at least one patch antenna element;

each of the at least one patch antenna element is provided with at least one parasitic conducting patch element; and wherein a vertical separation between a parasitic patch and an electrically driven conductive patch is less than 12% of a free space operating wavelength of the center frequency of the second frequency band.

25. The assembly according to claim 22, wherein the antenna assembly comprises two patches for providing radiation in two different orthogonal polarizations in a first frequency band and at least one patch for radiating in the second frequency band, wherein each of the two patches for radiating in the second frequency band is suitable for radiating in two orthogonal polarizations.

26. Assembly according to claim 25, wherein the two patches of the first band are provided in a cross geometry and the patches of the second band are four patches provided at least partially in the four empty corners of the cross geometry.

27. The assembly according to claim 15, wherein antenna assembly elements provided for one and the same band and polarization are provided with different feeding ports, wherein different feeding ports of the same band and frequency are provided with a signal which is 180° phase shifted.

28. An antenna array for dual-polarized radiation operable to radiate in at least two orthogonal polarizations independently of each other, wherein the antenna array is operable to operate in at least two frequency bands, providing in each of the at least two frequency bands two orthogonal polarizations wherein the antenna array comprises:

at least one of a plurality of radiating elements and a plurality of antenna assemblies;

wherein each radiating element of the plurality of radiating elements comprises:

a first patch radiating in a first polarization;

a second patch radiating in a second polarization;

wherein the second polarization is substantially orthogonal to the first polarization;

at least two feeding ports;

wherein each of the at least two feeding ports is coupled to at least one of the first patch and the second patch;

wherein a largest extension of each patch is provided at an angle between 90° and 75°;

wherein the first patch and the second patch are arranged such that two largest extensions cross each other not further away from one middle point than 15% of a length of the largest extension;

wherein the first patch and the second patch overlap;

wherein a plurality of antenna assemblies comprise:

at least one patch of the first patch and the second patch operating in a first frequency band; and wherein a center frequency of a second frequency band is at least 1.5 times a center frequency of a first frequency band but less than 2.5 times the center frequency of the first frequency band.

29. The antenna array of claim 28, wherein the antenna array comprises electrically driven patch antenna array elements which are combined with parasitic elements, wherein the antenna array has at least one of a feeding and a distribution network on the same layer as that of the electrically driven patches, wherein at least some of the electrically driven patches of one band are provided on this same layer, wherein parasitic elements are provided coplanar to electrically driven patches.

30. The antenna array of claim 28, wherein a feeding and/or distribution network for operation of the first frequency band is provided below a ground layer, wherein the ground layer is provided between the network layer of the first band and the network layer of the second band for isolation purposes.

31. The antenna array of claim 28, wherein different layers of antenna patches, parasitic elements and feeding/distribution networks are provided on the surfaces of different dielectric substrates, wherein between at least two of the dielectric substrates an air gap is provided, wherein the air gap is more than 0.2 mm and less than 2.0 mm.

32. The antenna array of claim 28, wherein at least two dielectric substrates are common for at least one of a plurality of antenna array elements, a plurality of radiating elements and a plurality of antenna assemblies, wherein at least one of the plurality of antenna array elements, the plurality of radiating elements and the plurality of antenna assemblies comprise at least one individual dielectric substrate.

* * * * *